US011460266B2

(12) United States Patent
Faifer

(10) Patent No.: US 11,460,266 B2
(45) **Date of Patent: *Oct. 4, 2022**

(54) FIREARM STABILIZING DEVICE AND APPARATUS

(71) Applicant: Sagi Faifer, Mishmar Hashiva (IL)

(72) Inventor: Sagi Faifer, Mishmar Hashiva (IL)

( * ) Notice: Subject to any disclaimer, the term of this patent is extended or adjusted under 35 U.S.C. 154(b) by 0 days.

This patent is subject to a terminal disclaimer.

(21) Appl. No.: 17/093,570

(22) Filed: Nov. 9, 2020

(65) Prior Publication Data

US 2021/0071986 A1 Mar. 11, 2021

Related U.S. Application Data

(63) Continuation of application No. 16/689,238, filed on Nov. 20, 2019, now Pat. No. 10,830,557.

(60) Provisional application No. 62/770,176, filed on Nov. 20, 2018.

(51) Int. Cl.
*F41A 23/12* (2006.01)
*F41C 23/12* (2006.01)

(52) U.S. Cl.
CPC ..... *F41C 23/12* (2013.01)

(58) Field of Classification Search
CPC ..... F41C 23/04; F41C 23/10; F41C 23/12; F41C 23/14
USPC ..... 42/71.01, 71.02, 72, 73, 74, 94
See application file for complete search history.

(56) References Cited

U.S. PATENT DOCUMENTS 10,830,557 B2 * 11/2020 Faifer ..... F41C 23/12

* cited by examiner

*Primary Examiner* — Bret Hayes
(74) *Attorney, Agent, or Firm* — Law Office of Arthur M. Antonelli, PLLC

(57) ABSTRACT

A firearm stabilizing accessory 16 is disclosed which may include a firearm interface 24, a distal joint 26, and a proximal joint 28. The firearm stabilizing accessory 16 may further include an arm 30 disposed between the distal joint 26 and the proximal joint 28. The proximal joint 28 may connect a boom 32 to the arm 30. The boom 32 may further include a brace 34 and a handle 36. The handle 36 may further include a surface 40 which may serve as a cheek weld for an operator of a handgun 12 which may be secured to the firearm interface 24.

24 Claims, 22 Drawing Sheets

FIREARM STABILIZING DEVICE AND APPARATUS

CROSS REFERENCE TO RELATED APPLICATIONS

This application is a continuation of application Ser. No. 16/689,238 filed Nov. 20, 2019, which claims the benefit of provisional Application No. 62/770,176 filed Nov. 20, 2018. The disclosure of each of these applications is incorporated by reference herein in their entirety.

FIELD OF THE INVENTION

The invention generally relates to a stabilizing accessory for a firearm. More particularly, the invention relates to a folding gun support.

BACKGROUND

Stabilizing accessories for firearms are known in the related art. These accessories may be used to provide support for a firearm and may facilitate enhanced accuracy of the weapon during operation.

SUMMARY

Hence, the present invention is directed toward a firearm stabilizing device for positioning a handgun in spatial relation to an operator's torso. The firearm stabilizing device may include a firearm interface which includes a stem for connecting to a grip of a handgun, and a first eye end spaced from the stem. The first eye end may include a first stub. Further, the first stub may include an upper surface, a lower surface, and a first eye. The first eye may extend from the upper surface to the lower surface. Moreover, the first eye may include a first rectangular slot which extends from the upper surface toward the lower surface, the first rectangular slot comprising a first end wall. Additionally, the first eye may include a first circular bore which extends from the lower surface toward the upper surface, the first circular bore comprising a second end wall. Further still, the first eye may include a first passage extending from the first end wall to the second end wall.

The firearm stabilizing device may, moreover, may further include an arm which comprises a first fork end. The first fork end may include a superior tine. The superior tine may include a first top surface, a first bottom surface, and a first superior slot which extends from the first top surface to the first bottom surface. The superior slot may comprise a rectangular shape. Also, the arm may include an inferior tine spaced from the superior tine. The inferior tine may include a second top surface, a second bottom surface, and a second circular bore which extends from the second top surface to the second bottom surface. The firearm stabilizing device further may include a first latch bolt. The first latch bolt may include a first head and a first shank, the first head being positioned in the superior slot and the first shank being positioned in the first passage and the second circular bore.

Additionally, the firearm stabilizing device may include a first latch bolt nut positioned in the first circular bore and the second circular bore. The first latch bolt nut may be secured to the first shank. Also, the firearm stabilizing device may include a first spring positioned intermediate to the second end wall and the first latch bolt nut such that the firearm stabilizing device comprises a first locked configuration in which the first head is positioned in the first rectangular slot and blocks rotation of the first fork end with respect to the first eye, and a first unlocked configuration in which the first head is spaced from the first rectangular slot and allows rotation of the first fork end with respect to the first eye, and the first spring biases the first latch bolt in the first locked configuration.

Further still the present invention is directed toward a firearm stabilizing apparatus. The firearm stabilizing apparatus may include a pistol comprising a pistol grip, and a firearm stabilizing device connected to the pistol grip as disclosed herein.

DESCRIPTION OF THE DRAWINGS

In the accompanying drawings, which form part of this specification and are to be read in conjunction therewith and in which like reference numerals are used to indicate like parts in the various views.

DESCRIPTION

Figure 1:
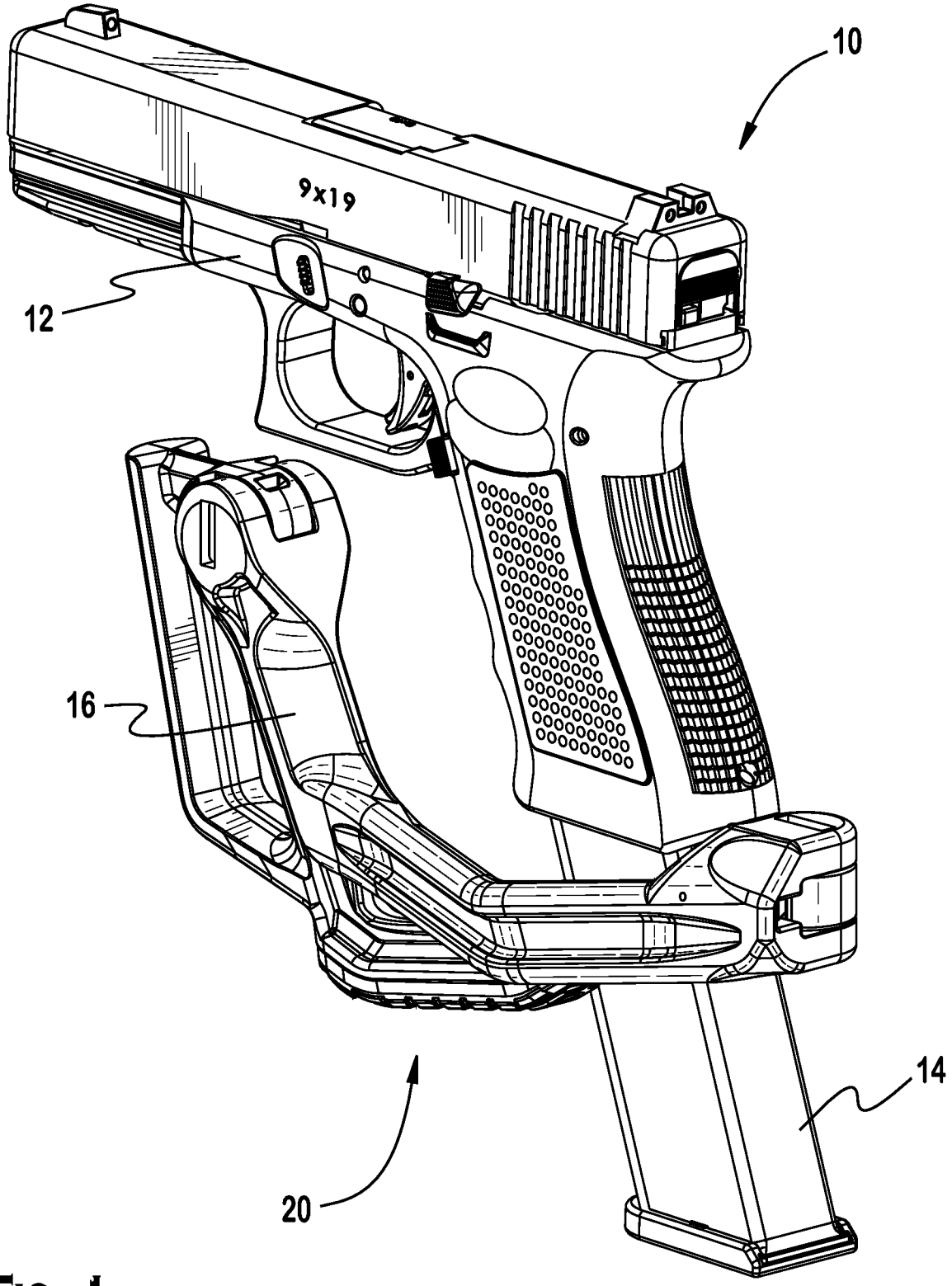
FIG. 1 is perspective view of an exemplary firearm apparatus in a stored (or folded) configuration.
Figure 2:
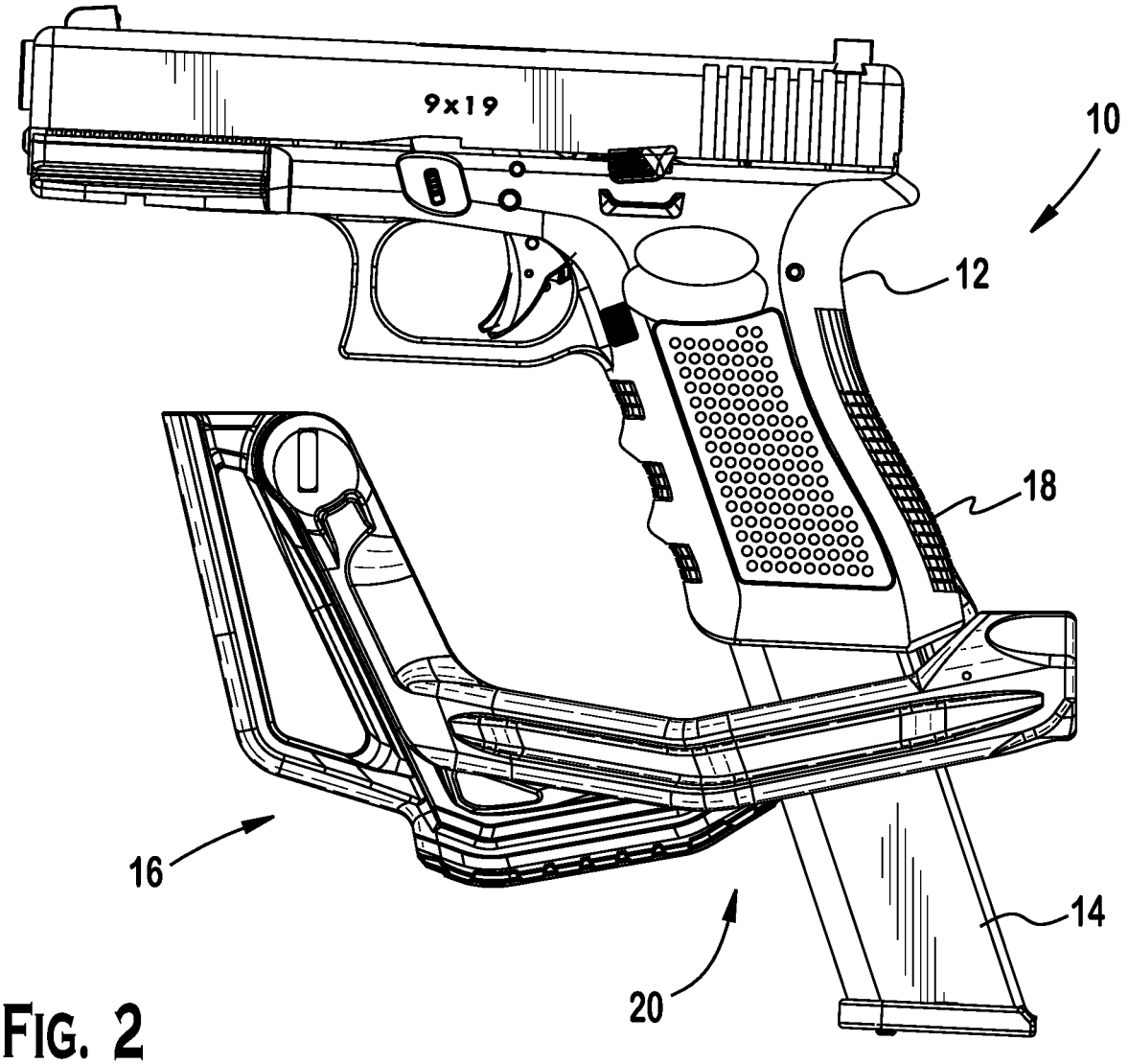
FIG. 2 is a left side view of the apparatus of FIG. 1.
Figure 3:
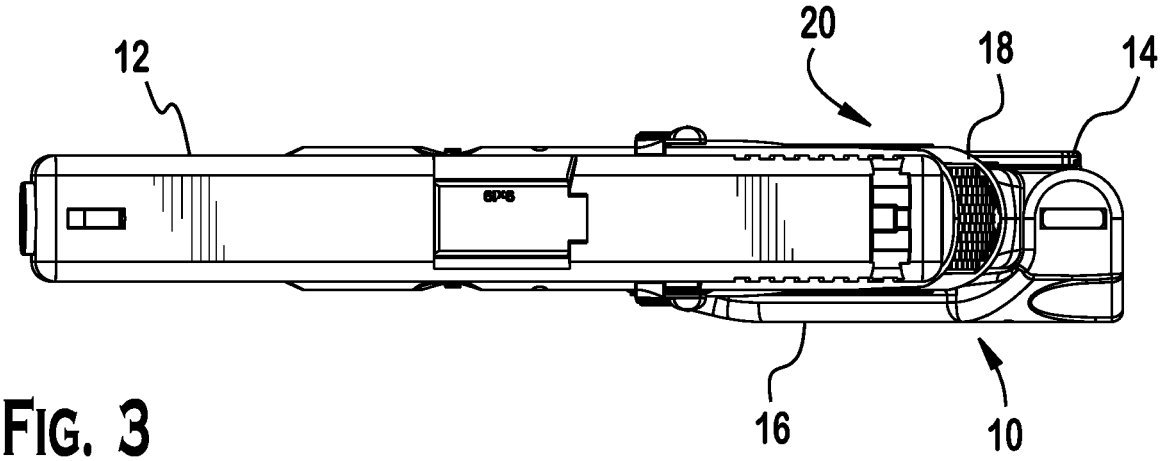
FIG. 3 is a top view of the apparatus of FIG. 1.
Figure 4:
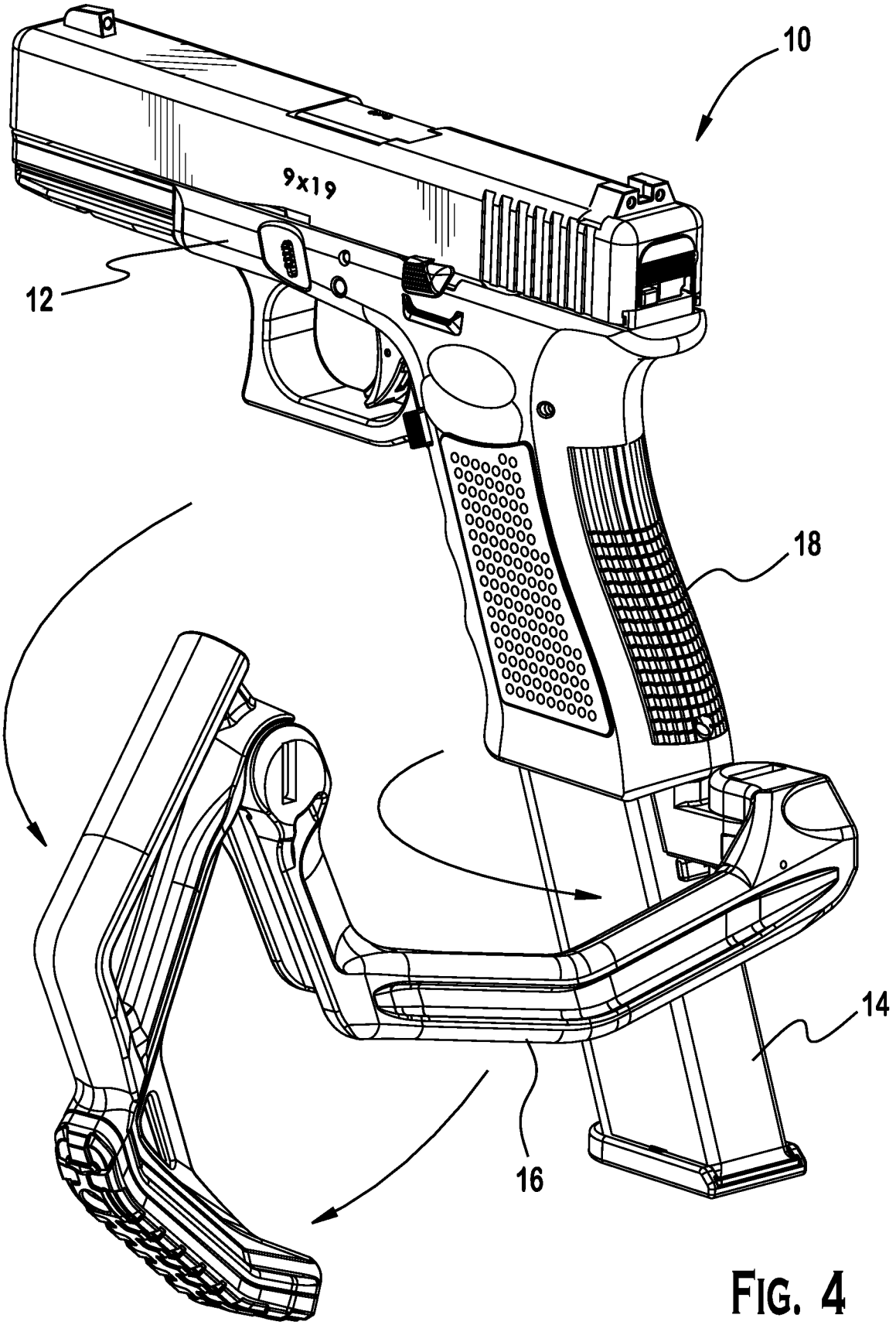
FIG. 4 is a perspective view of the apparatus of FIG. 1 illustrating the stabilizing accessory transforming from the stored configuration that is depicted in FIG. 1 to a deployed configuration that is depicted in FIG. 5.

FIG. 1 shows a perspective view of an exemplary firearm apparatus 10. The firearm apparatus 10 may include a pistol 12, an ammunition magazine 14, and a firearm stabilizing accessory (or device) 16. As shown in FIG. 2, the firearm stabilizing accessory 16 may be connected to the pistol 12 at the heel of the pistol grip 18. Referring to FIGS. 1. 2 and 3, the firearm stabilizing accessory may be positioned under the pistol to provide the firearm apparatus 10 with a compact size. For example, in the embodiment shown in FIG. 1 the envelope of the folded firearm stabilizing device 16 may be approximately 140 mm tall, 240 mm long, and 42 mm wide. When the firearm apparatus 10 is arranged as shown in FIGS. 1-3, the firearm apparatus is in a stored configuration 20. Referring to FIG. 4, the firearm apparatus 10 may be transformed from the stored configuration 20 which is illustrated in FIGS. 1, 2 and 3 to a deployed configuration 22, as shown in FIGS. 5, 6, 7 and 8. In the exemplary embodiment, the deployed firearm stabilizing device 16 may have a length of approximately 332 mm and a height of approximately 153 mm.

Figure 5:
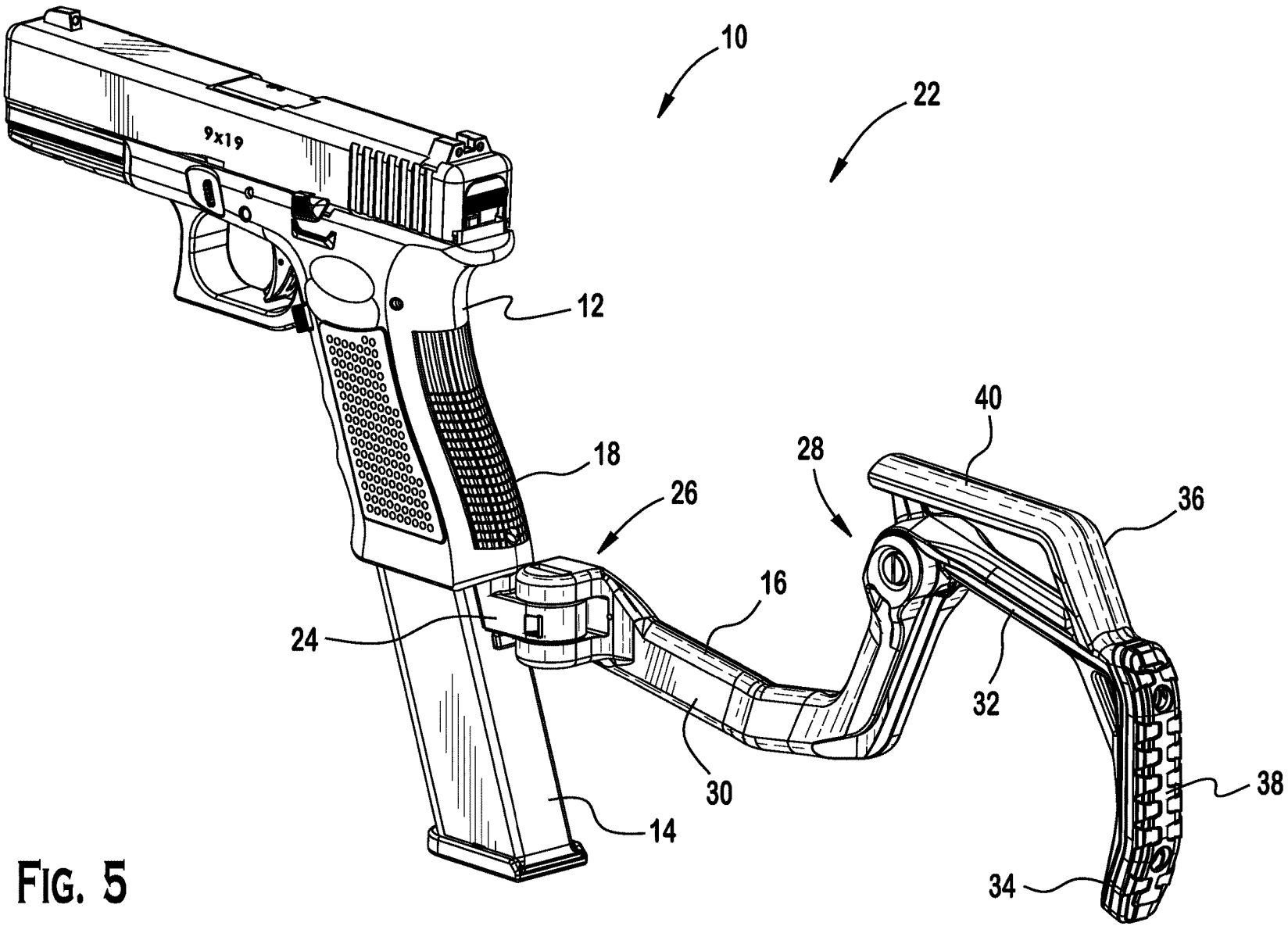
FIG. 5 is perspective view of the apparatus of FIG. 1 in a deployed (or unfolded) configuration.
Figure 6:
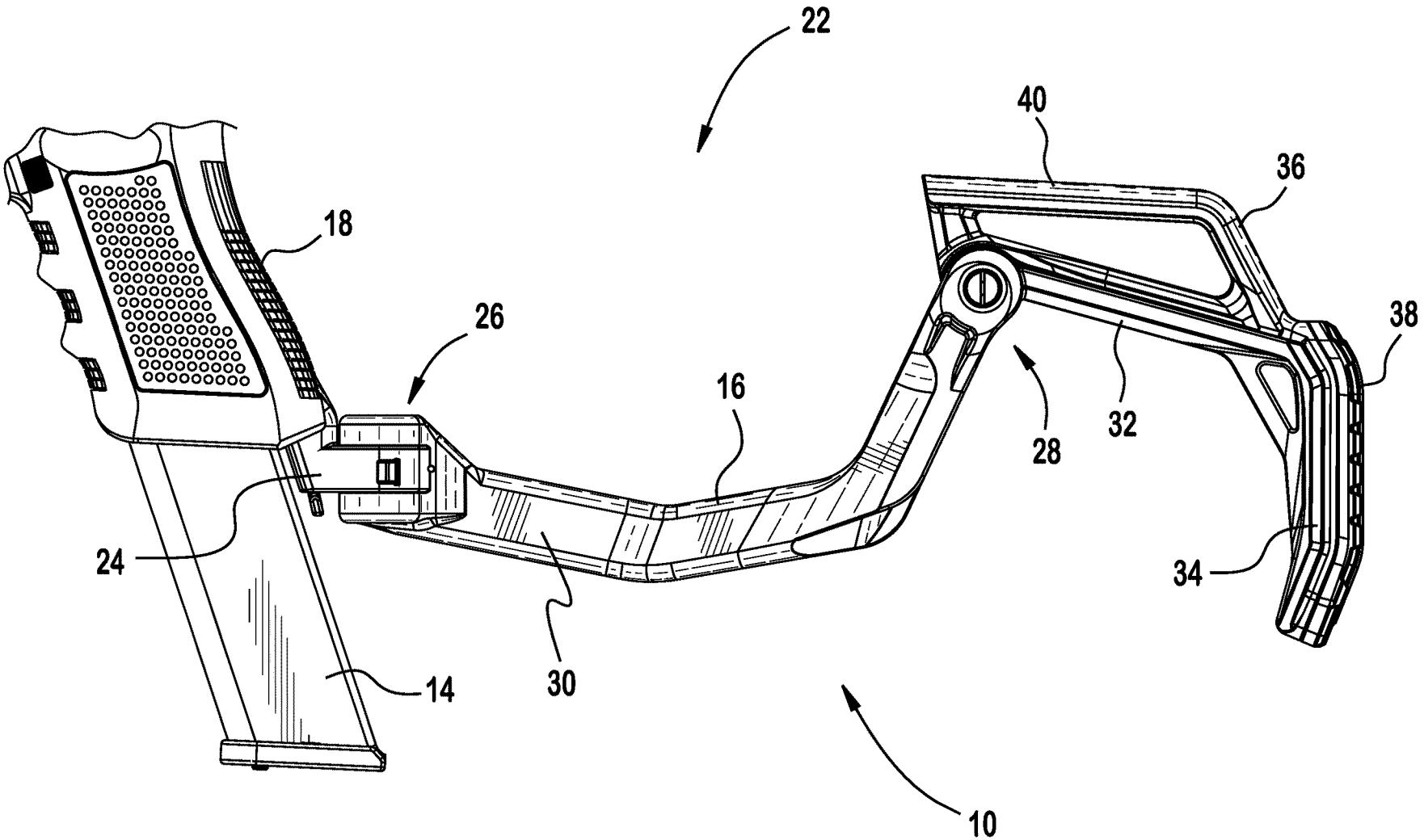
FIG. 6 is partial left side view of the apparatus of FIG. 5.

Referring to FIGS. 5 and 6, the firearm stabilizing accessory 16 may include a firearm interface 24, a distal joint 26, and a proximal joint 28. The firearm stabilizing accessory 16 may further include an arm 30 disposed between the distal joint 26 and the proximal joint 28. The proximal joint 28 may connect a boom 32 to the arm 30. The boom 32 may further include a brace 34. The boom 32 may include a handle 36, and the brace 34 may include a recoil pad 38. The handle 36 may further include a smooth curved surface 40 which may be positioned to serve as a check weld for a user when the firearm apparatus 10 is in the deployed configuration 22 (see e.g. FIGS. 5, 6, 7 and 8). As shown in FIG. 5, the front sight and rear sight of the pistol may define a longitudinal axis 41 for the firearm apparatus 10. Additionally, the distal joint 26 may oscillate about a vertical axis 43 which is perpendicular to the longitudinal axis. Further, the proximal joint 28 may oscillate about a horizontal axis 45 which is perpendicular to the longitudinal axis and the vertical axis.

Figure 7:
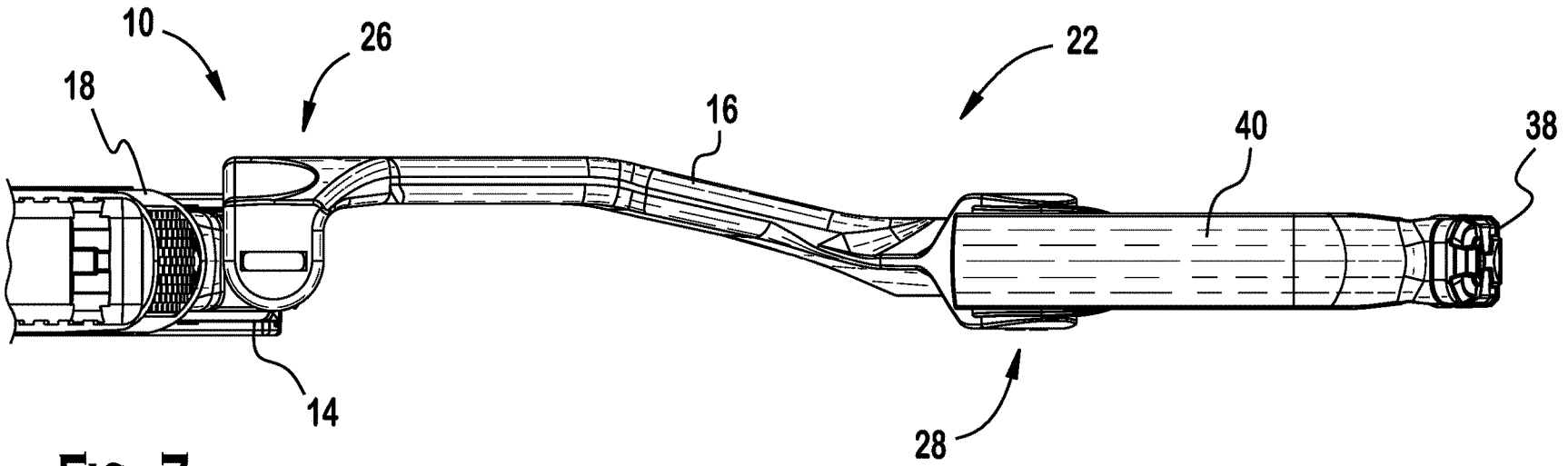
FIG. 7 is a top view of the apparatus of FIG. 6.
Figure 8:
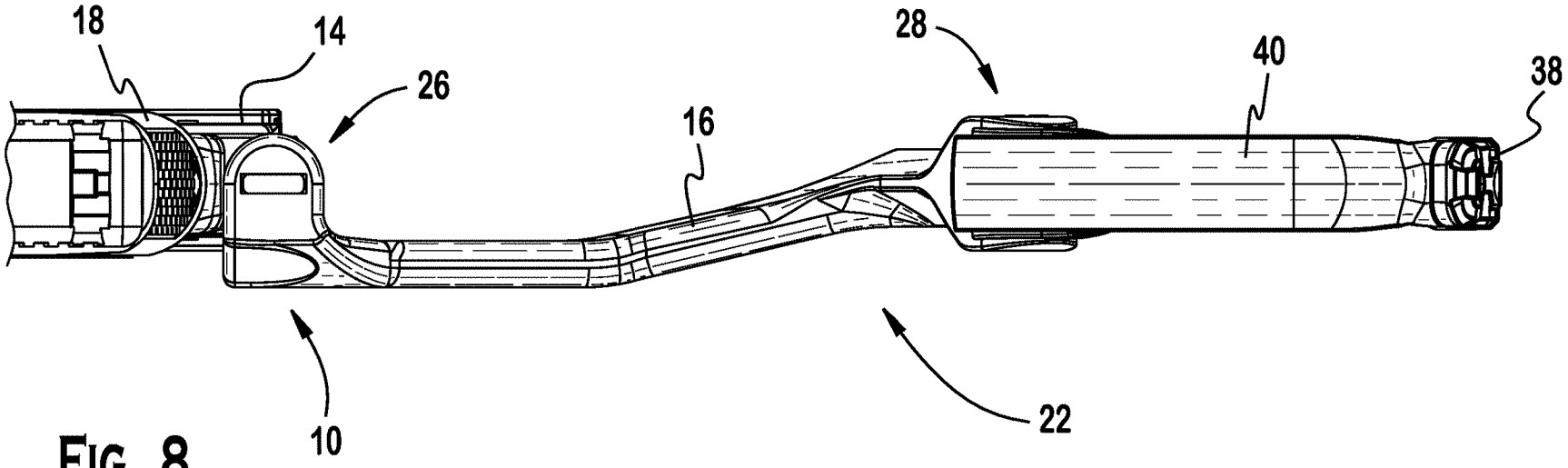
FIG. 8 is a top view of another embodiment of the apparatus of FIG. 6 configured for left dominant hand operation.

Referring to FIGS. 7 and 8, the arm 30 may be curved and further may bend toward the longitudinal axis. Additionally, the boom 32 and handle 36 may be aligned with the longitudinal axis. In the embodiment, shown in FIG. 7 the distal joint 26 rotates clockwise from the deployed configuration 22 to the stored configuration (see e.g., FIG. 1). By contrast, in the embodiment shown in FIG. 8, the distal joint 26 rotates clockwise from the deployed configuration 22 to the stored configuration 20 (not shown).

Figure 9:
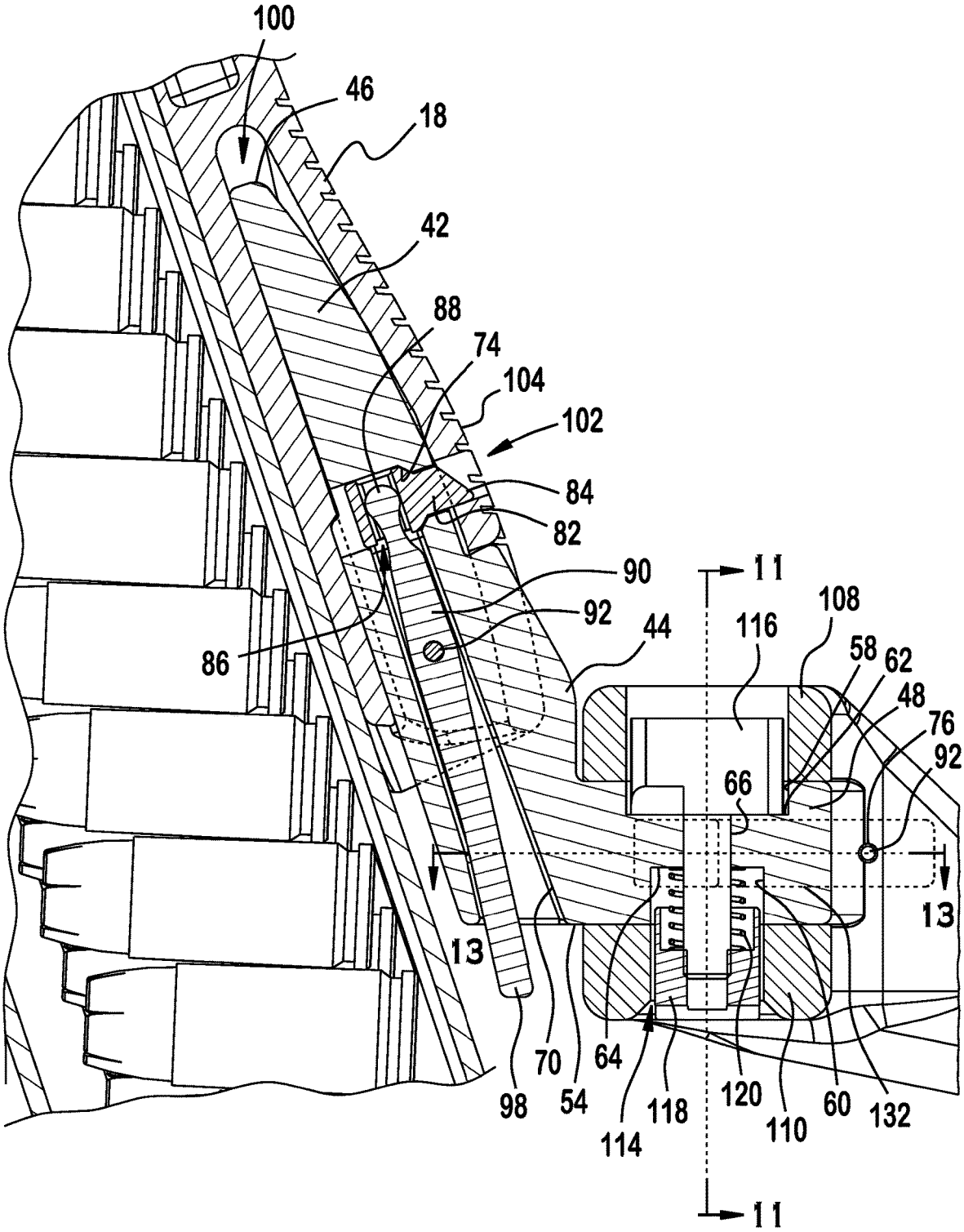
FIG. 9 is a partial sectional view of the pistol grip, pistol grip interface, and distal joint along the longitudinal axis of the firearm apparatus.
Figure 10:
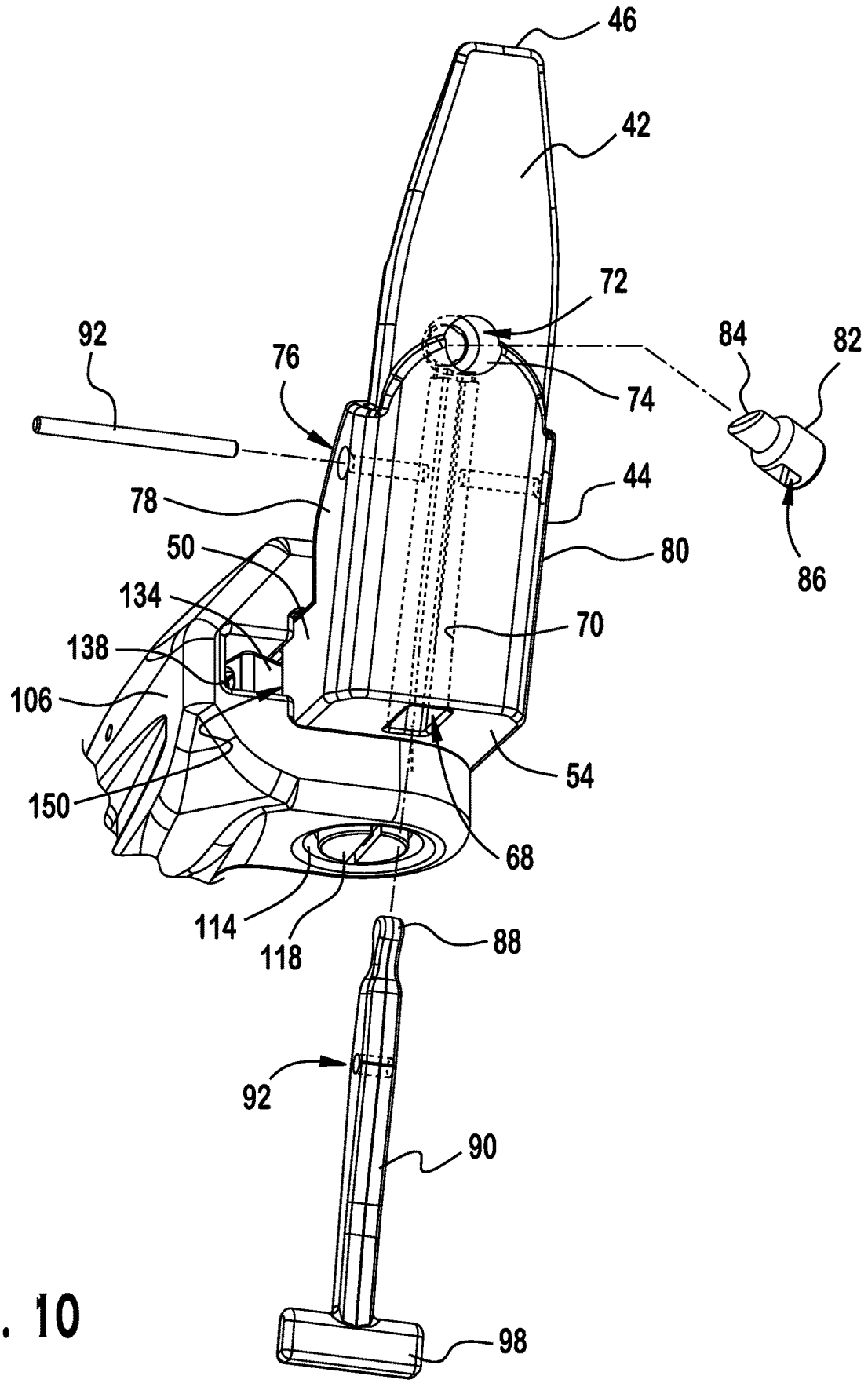
FIG. 10 is a front, bottom, right side perspective view of the pistol grip interface and distal joint of FIG. 6, the pistol grip interface showing a pistol grip locking mechanism in exploded view.

Referring to FIG. 9 and FIG. 10, the firearm interface 24 may include a stem 42 which extends from a base 44 to a tip 46. The base 44 may include an inclined passage 68 which may extend from the lower surface 54 of the base 44 toward the tip 46. The cross-section of the side walls 70 perpendicular to the length of the inclined passage 68 may be rectangular. Additionally, the cross-section of the side walls 70 may taper along the length of the inclined passage. The inclined passage 68 may intersect a recess 72 located inside the base. The side walls 74 of the recess may define a counter sunk bore which extends from the distal side of the firearm interface to the proximal side of the firearm interface. The recess 72 may straddle adjacent portions of the base 44 and the tip 46. Moreover, the base 44 may include a cross-passage 76 which extends from the starboard side 78 of the base to the port side 80 of the base 44.

Referring to FIG. 10, a cylindrical bit 82 with an angled face 84 may be housed in the recess 72. The cylindrical bit may be tapered. The cylindrical bit 82 may include a cavity 86. The cavity 86 may be configured and dimensioned to receive the working end 88 of a lever 90 that is positioned within the inclined passage 68 to create an interference fit. The lever 90 may include a through bore 92 which may align with the cross-passage 76 in the base 44 of the firearm interface when the working end 88 of the lever is positioned within the cavity 86 of the cylindrical bit 82. A pin 94 may be inserted into the cross-passage 76 and through bore 92 to secure the lever 90 within the inclined passage 68. The pin 94 may serve as a fulcrum about which the lever 90 may oscillate. The lever 96 may extend out of the inclined passage 68 and may include a crosstab 98.

As shown in FIG. 9, the stem 42 may be configured and dimensioned to be received within a chamber 100 of the pistol grip 18. The stem 42 may mate with the chamber 100 to prevent relative movement between the firearm interface 24 and the pistol grip 18. Further, the stem 42 may form an interference fit with the chamber 100. The pistol grip 18 may include an aperture 102 that extends from the outer surface 104 of the pistol grip to the cavity 100. Additionally, the cylindrical bit 82 may protrude into the aperture to fix the firearm interface 24 to the pistol grip 18. The cylindrical bit 82 may be withdrawn from the aperture by moving the cross tab 98 rearward or toward the distal joint 26. The base may engage with or form a seat for a lower portion of the pistol grip to further enhance the stability of the connection between the firearm interface 24 and the pistol 12.

Figure 15:
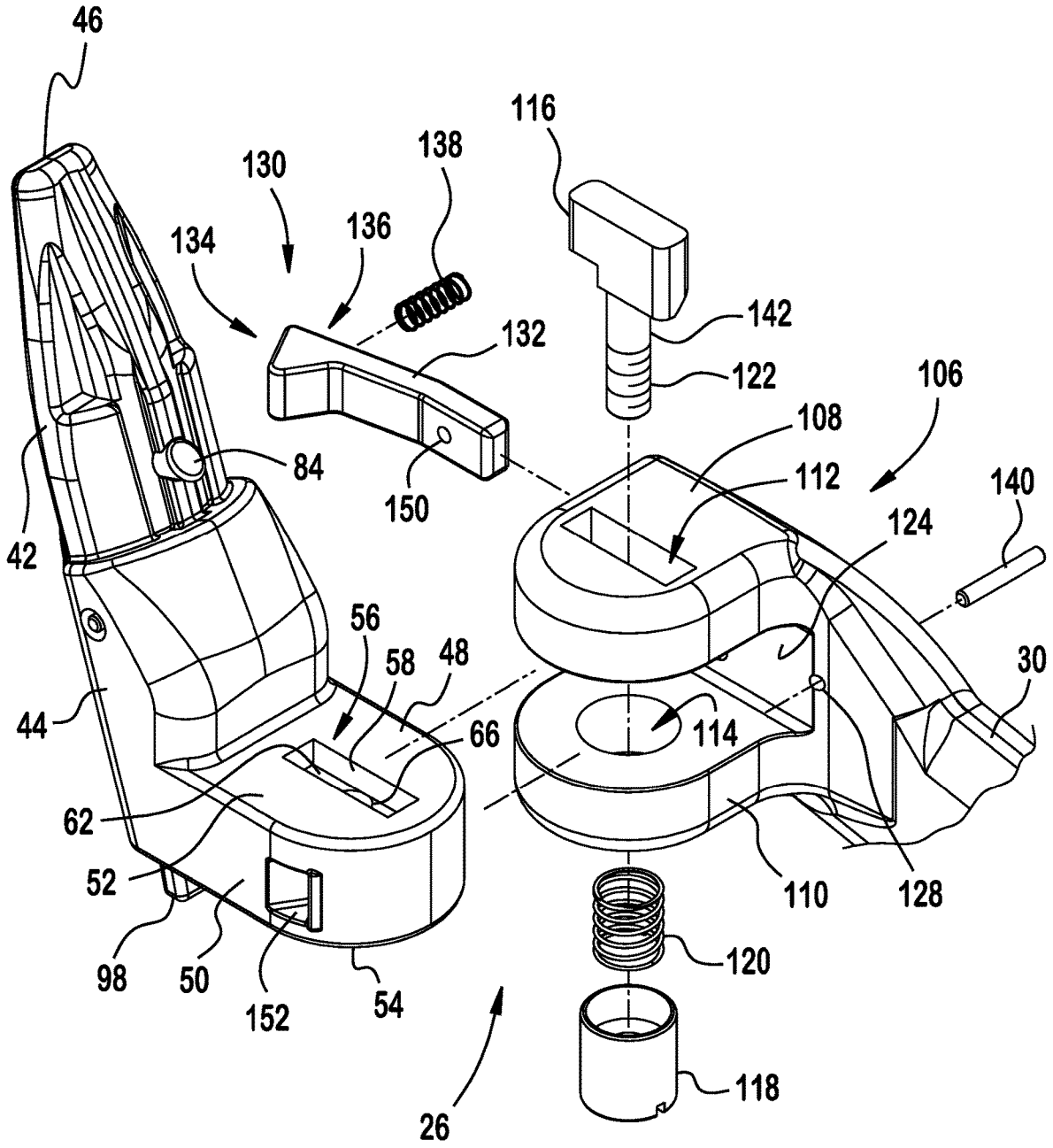
FIG. 15 is a rear, top, left side perspective view of the pistol grip interface and distal joint of FIG. 10 showing the distal joint in exploded view.

As shown in FIG. 15, the firearm interface 24 may include an eye end 48. The eye end 48 may be configured and dimensioned to cooperate with a fork end 106 of the arm 30 to form the distal joint 26. The distal joint 26 may rotate clockwise from the deployed configuration 22 to the stored configuration (see e.g., FIG. 1). The eye end 48 may include a stub 50 with an upper surface 52 and a lower surface 54. The upper and lower surfaces 52, 54 may be generally flat and smooth, as well as generally parallel to each other. The stub may include an eye 56 which may extend from the upper surface 52 to the lower surface 54.

Referring to FIG. 9, the eye 56 may include a rectangular slot 58 that extends from the upper surface 52 toward the interior of the stub 50, as well as a circular bore 60 that extends from the lower surface 54 toward the interior of the stub 50. The rectangular slot may include an end wall 62, and the circular bore may include an end wall 64. The end wall 62 of the rectangular slot and the end wall 64 of the circular bore may be connected by an intermediate passage 66. The intermediate passage 66 may be a circular bore of smaller diameter than the circular bore 60 in the lower surface 54.

Referring to FIG. 9 and FIG. 15, the fork end 106 of the distal joint 26 may include a superior tine 108 and an inferior tine 110. The superior tine 108 may include a superior slot 112 that extends from the top surface to the bottom surface of the superior tine. The superior slot 112 may be rectangular. The superior slot 112 may possess the same cross-sectional dimensions as the rectangular slot 58 in the eye end 48. The inferior tine 108 may include a circular bore 114. The distal joint 26 may further include a latch bolt 116, a latch bolt nut 118, and a coil spring 120. The latch bolt 116 and the latch bolt nut 118 may include mating screw threads 122, 230.

Figure 11:
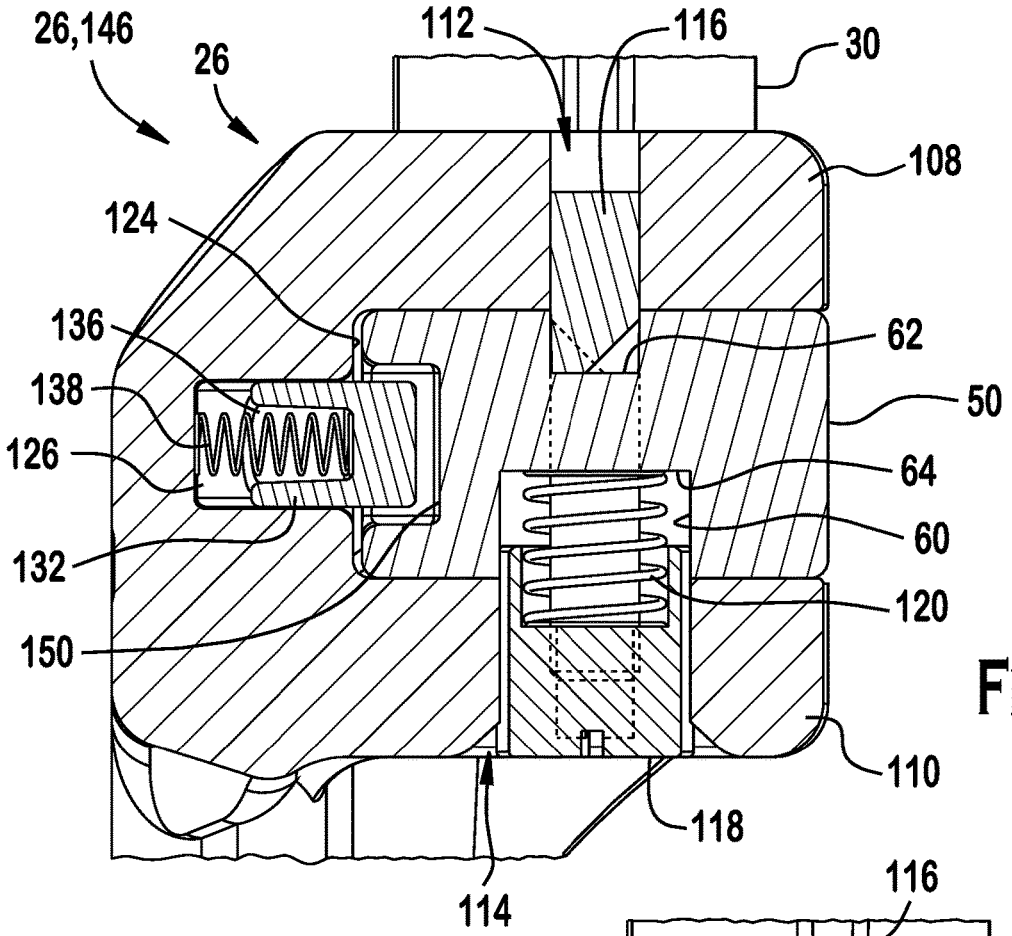
FIG. 11 is a partial sectional view of the distal joint of the stabilizing accessory along line 11-11 of FIG. 9, the distal joint being depicted in a locked configuration.
Figure 12:
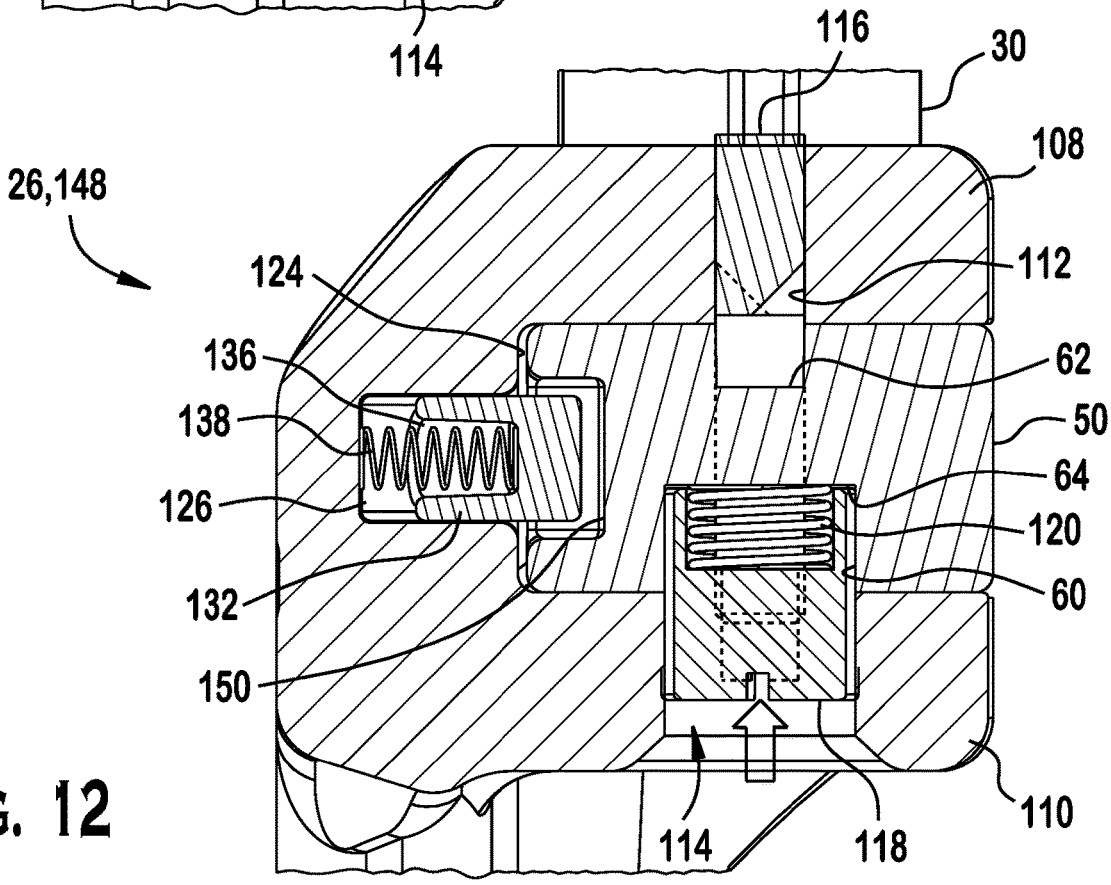
FIG. 12 is a partial sectional view of the distal joint of the stabilizing accessory along line 11-11 of FIG. 9, the distal joint being depicted in an unlocked configuration.

Referring to FIG. 9 and FIG. 11, the eye end 48 of the firearm interface 24 may be positioned between the superior tine 108 and the inferior tine 110 of the fork end 106. The latch bolt 116 may be inserted into the superior rectangular slot 112 and seated within the rectangular slot 58. The shank 142 of the latch bolt 116 may pass through the intermediate passage 66 into the circular bore 60 in the lower surface of the stub 50. The coil spring 120 may be placed in the intermediate passage 66 over the shank 142 of the latch bolt 116. The latch bolt nut 118 may be advanced onto screw threads 122 on the shank 142. As the latch bolt nut is advanced the coil spring compresses and pulls the latch bolt head 144 down against the end wall 62 of the rectangular slot 58. The latch bolt head 144, however, also may be disposed in the rectangular slot 112 of the superior tine. In this configuration, the latch bolt 116 blocks rotational movement between the eye end 48 and the fork end 106 to lock the distal joint 26. Hence, FIG. 11 shows the distal joint 26 in a locked configuration 146. By contrast, FIG. 12 shows the distal joint 26 in an unlocked configuration 148. Upward pressure against the latch bolt nut 118 compresses the coil spring 120 against the end wall 64 of the circular bore 60 and pushes the shank 142 and latch head 134 of the latch bolt 116 away from the end wall 62 of the rectangular slot 58. When the latch head 134 is raised above the rectangular slot 58, the latch bolt 116 allows rotational movement between the eye end 48 and the fork end 106 to unlock the distal joint 26.

Figure 13:
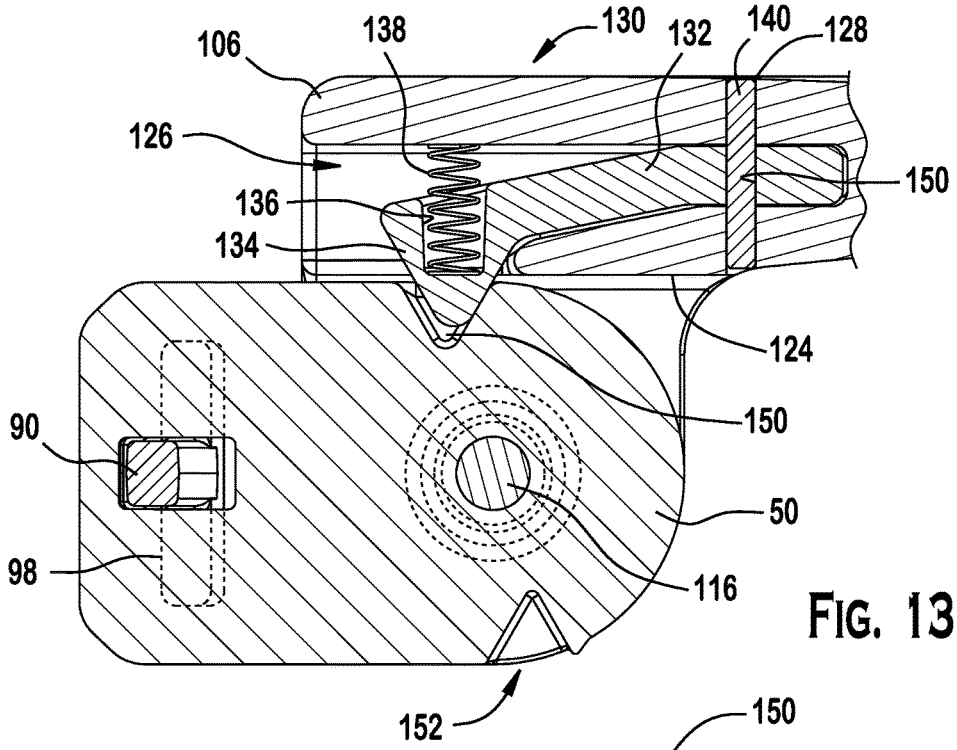
FIG. 13 is a partial sectional view of the distal joint along line 13-13 of FIG. 9, the distal joint being depicted in the deployed configuration.

Referring to FIG. 13, the root 124 of the fork end 106 may further include a pocket 126 (see also, FIG. 11 and FIG. 12) and a fastener receiving hole 128. The pocket 126 may be sized to receive a secondary latch 130. The secondary latch 130 may include an elongated member 132 having a wedge-shaped head 134. Generally, the secondary latch may be axe shaped. The elongated member 132 further may include a bore 136 opposite the wedge-shaped head 134 for housing a coil spring 138. The elongated member may further include a fastener receiving bore 138 which may be sized to receive a fastener 140. The elongated member 132 and coil spring 138 may be positioned within the root 124 and the fastener 140 may pass through the fastener receiving holes 128 in the fork end 106 and a through bore 150 in the elongated member 132 to fix the secondary latch 130 in the pocket 126.

Figure 14:
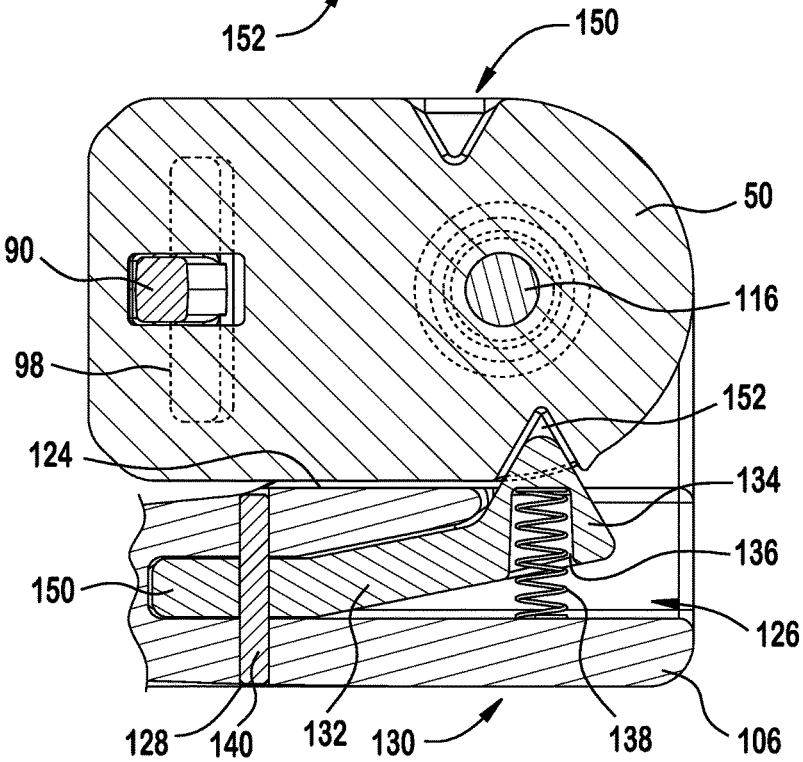
FIG. 14 is a partial sectional view of the distal joint along line 13-13 of FIG. 9, the distal joint being depicted in the stored configuration.

Referring to FIG. 13 and FIG. 14, the port side notch 150 and the starboard side notch 152 are configured and dimensioned to receive the wedge 156 of the elongated member 132 when the secondary latch 130 is rotated to a position opposite each respective notch. The secondary latch may hold the distal joint, but not lock the distal joint. Instead, referring to FIG. 13, the starboard side notch may automatically catch the secondary latch 130 and position the arm 30 to quickly facilitate alignment of the rectangular slot 58 with respect to the superior slot 112 so that the latch bolt 116 may seat in these slots 58, 112 and lock the distal joint 26. Referring to FIG. 14, the port side notch may hold the arm 30 in a folded configuration without locking the distal joint to allow for rapid deployment of the stabilizing accessory while maintaining a compact package. The secondary latch may further enhance stability of the accessory by squeezing the eye end 50 between the latch bolt 116 and the spring loaded elongated member 132.

Figure 16:
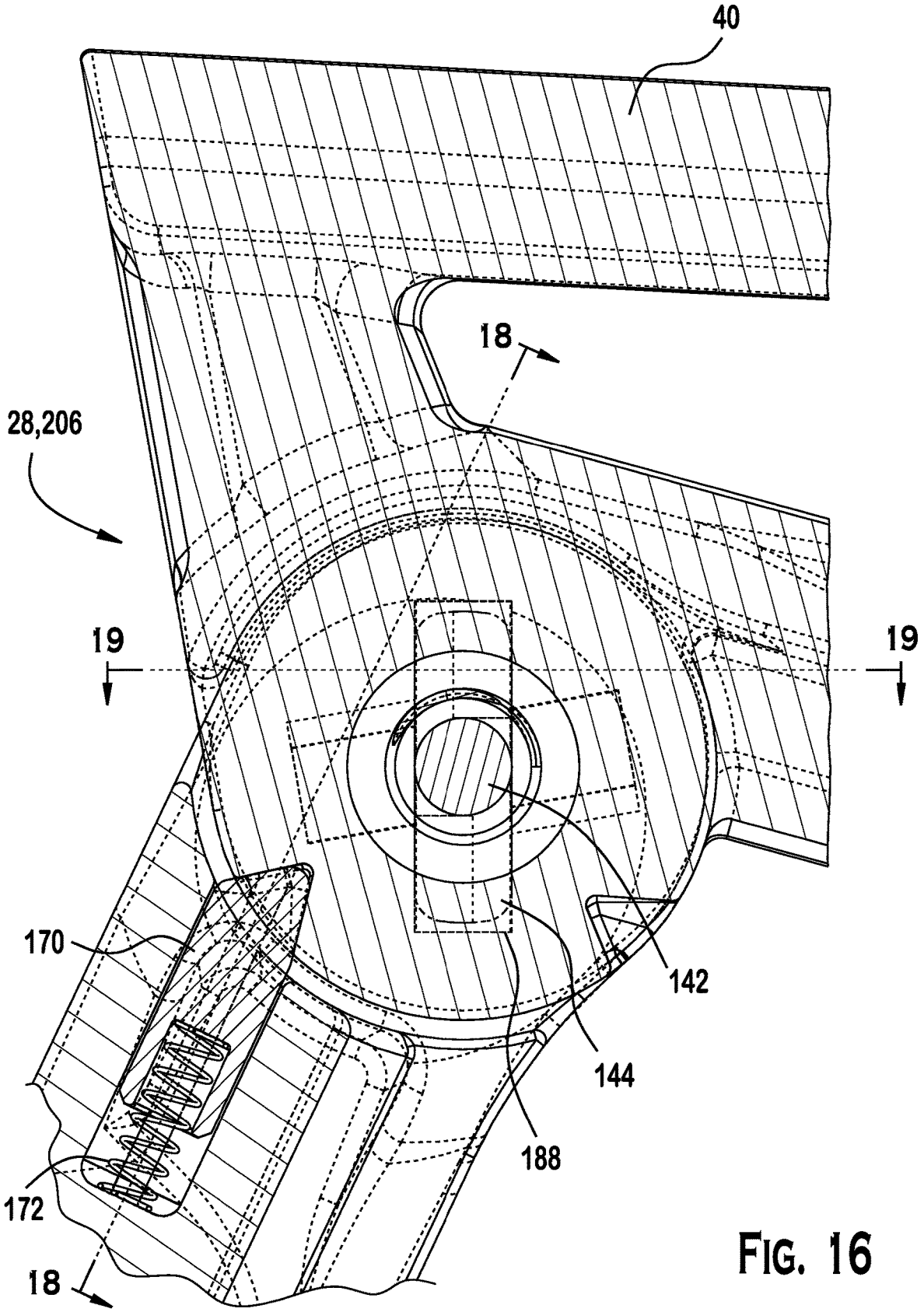
FIG. 16 is a right side close-up view of the proximal joint in the deployed configuration (e.g., FIG. 6)
Figure 17:
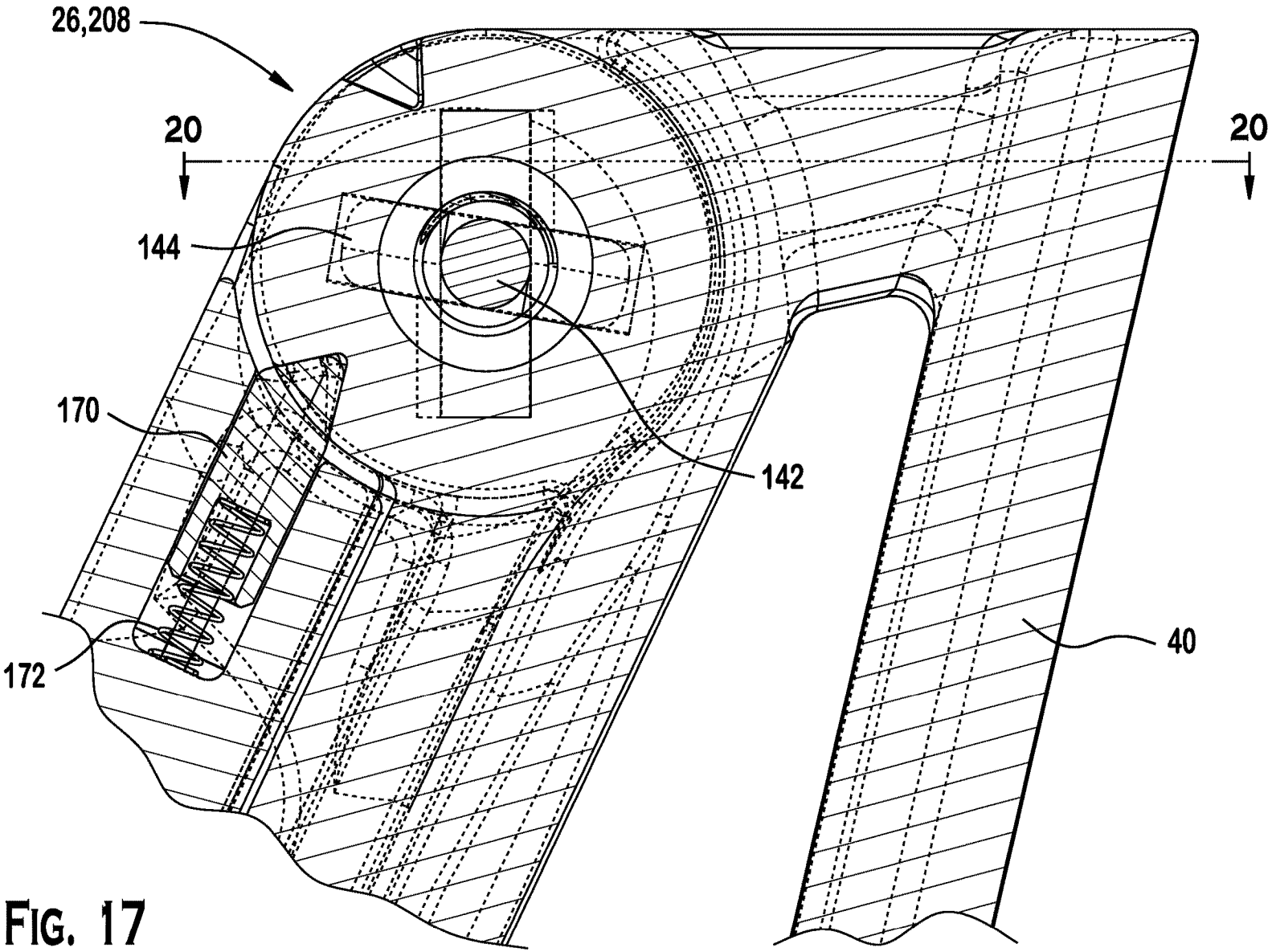
FIG. 17 is a right side close-up view of the proximal joint in the stored configuration (e.g., FIG. 1)
Figure 21:
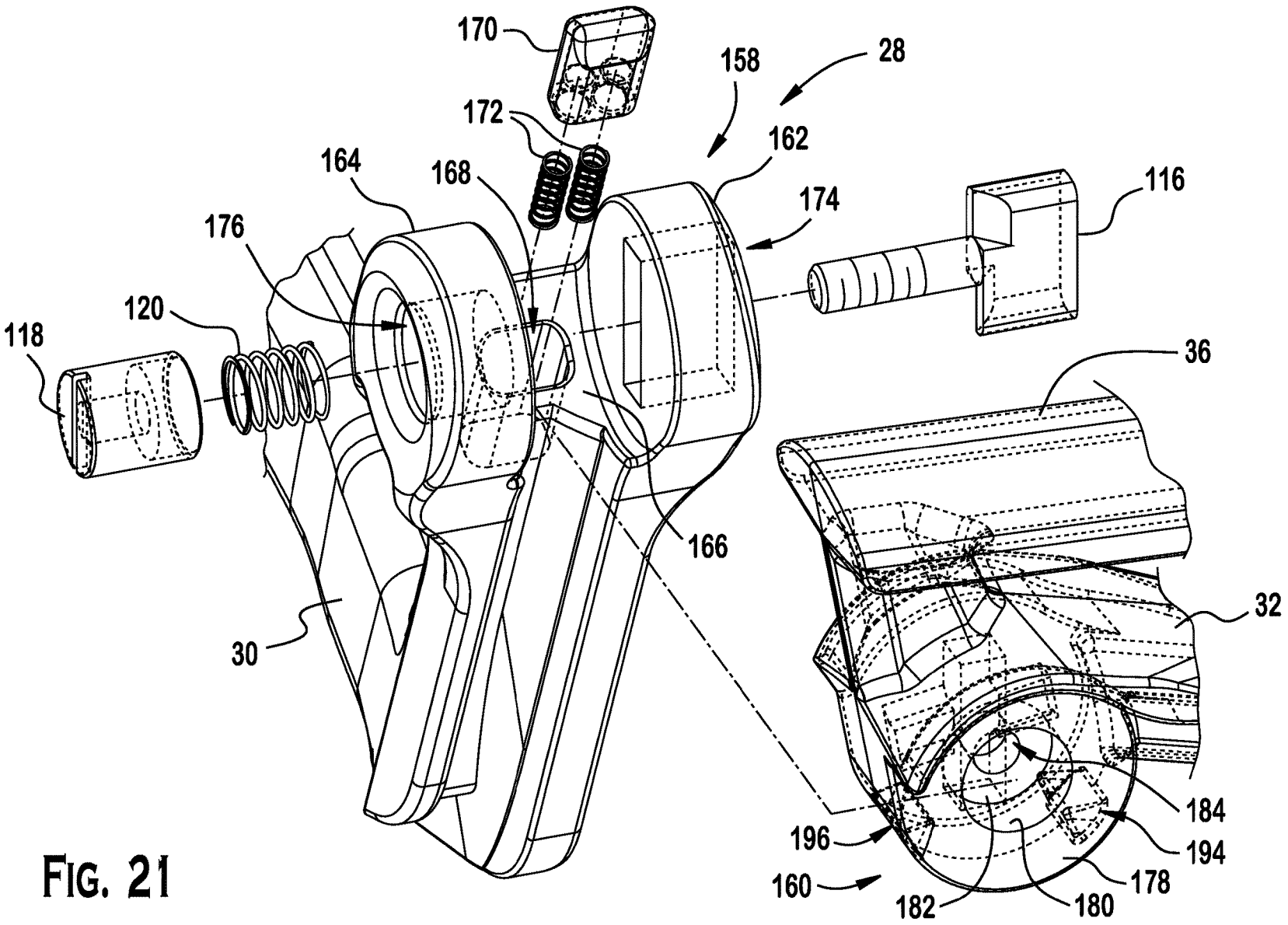
FIG. 21 is a rear, top, left side perspective view of the proximal joint of FIG. 6 in exploded view.
Figure 22:
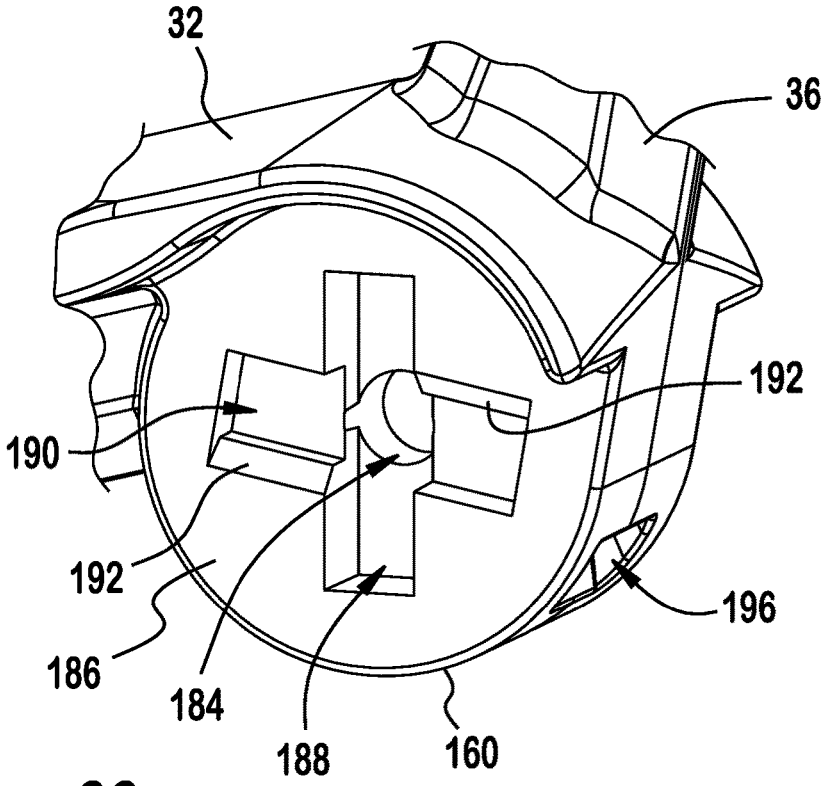
FIG. 22 is a right side close-up perspective view of the eye end of the proximal joint of FIG. 6.
Figure 23:
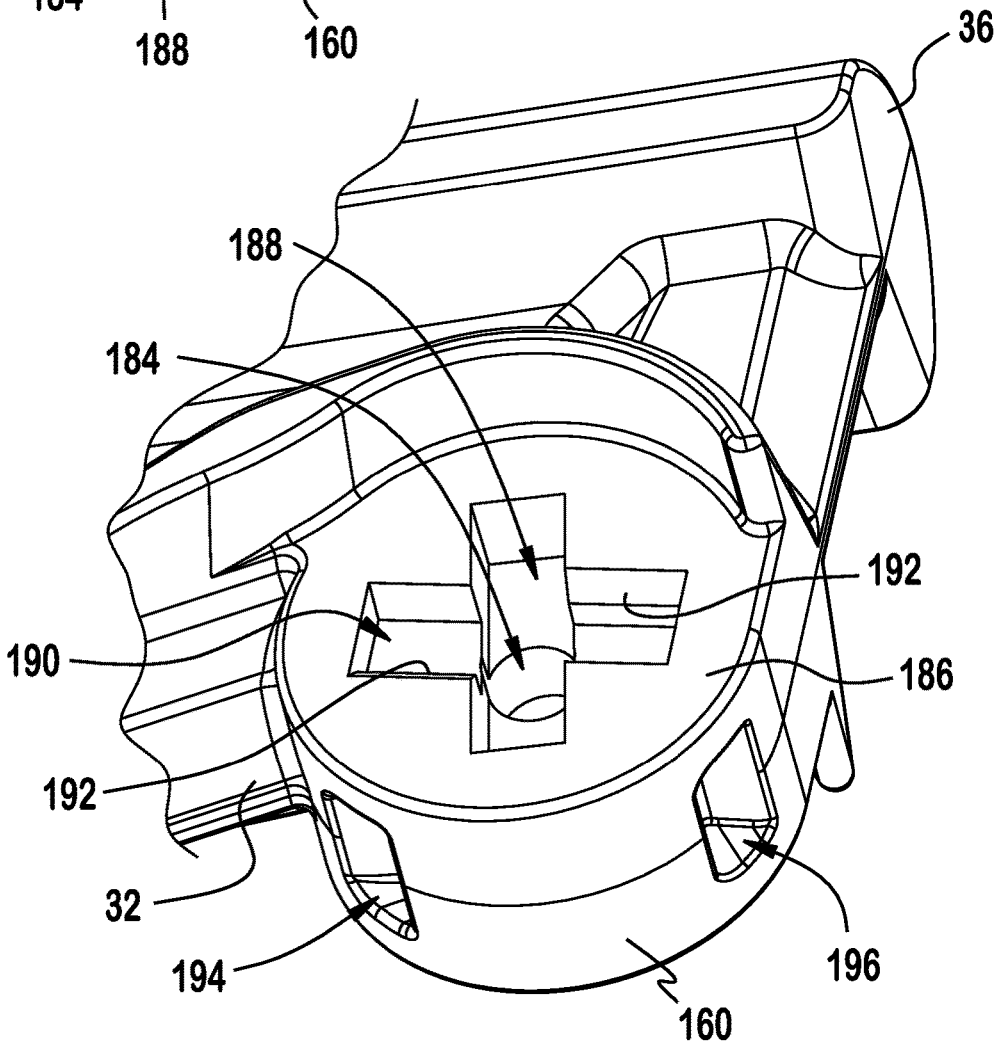
FIG. 23 is another right side close-up perspective view of the eye end of the proximal joint of FIG. 6.

FIG. 16 shows a right side close-up view of the proximal joint 28 in the deployed configuration (e.g., FIG. 6). Referring to FIG. 21, the proximal joint 28 may include a fork end 158, an eye end 160, a latch bolt 116, a latch bolt nut 118, and a coil spring 120. The fork end may include a starboard side tine 162, a port side tine 164, and a root 166. The root 166 may include a receptacle 168. The receptacle may be configured and dimensioned to receive a positioning latch 168. The positioning latch 168 may include latch bit 170 and a pair of coil springs 172. The coil springs 172 may be the same as each other. Also, the coil springs may be the same as the coil spring 138 of the distal joint secondary latch 130, but they may be different in other embodiments. The starboard side tine 162 may include a rectangular slot. The port side tine may include a circular bore 176. Additionally, the port side of the eye end 160 may include a counter bore 180 that is similar to that of the inferior tine 110 of the distal joint 26. Thus, the counter bore may include an end wall 182 and an interior bore 184 of smaller diameter. Referring to FIG. 22 and FIG. 23, the starboard side 186 of the eye end 160 may include a rectangular slot 188. The depth of the rectangular slot 188 in the proximal eye end 160 may be deeper than the rectangular slot in the distal eye end 48. The rectangular slot 188 may intersect the interior bore 184. The starboard side eye end 160 further may include a partially tapered slot 190. The partially tapered slot 190 may transect the rectangular slot 188 and the interior bore 184 at an angle. The angle may be an acute angle. For example, without limitation, the angle may be approximately 85 degrees. The partially tapered slot may be less deep than the rectangular slot 188. The partially tapered slot may include a beveled surface 192 on each side of the interior bore 184. Also, the side wall of the proximal eye end 160 may include a pair of notches 194, 196. The positioning notch 194 closer to the boom 32 may engage the latch bit 170 when the boom 32 is in the folded configuration (see e.g., FIG. 17). By contrast, the positioning notch 196 that is further from the boom 32 may engage the latch bit 170 when the boom 32 is in the unfolded configuration (see e.g., FIG. 16).

Figure 18:
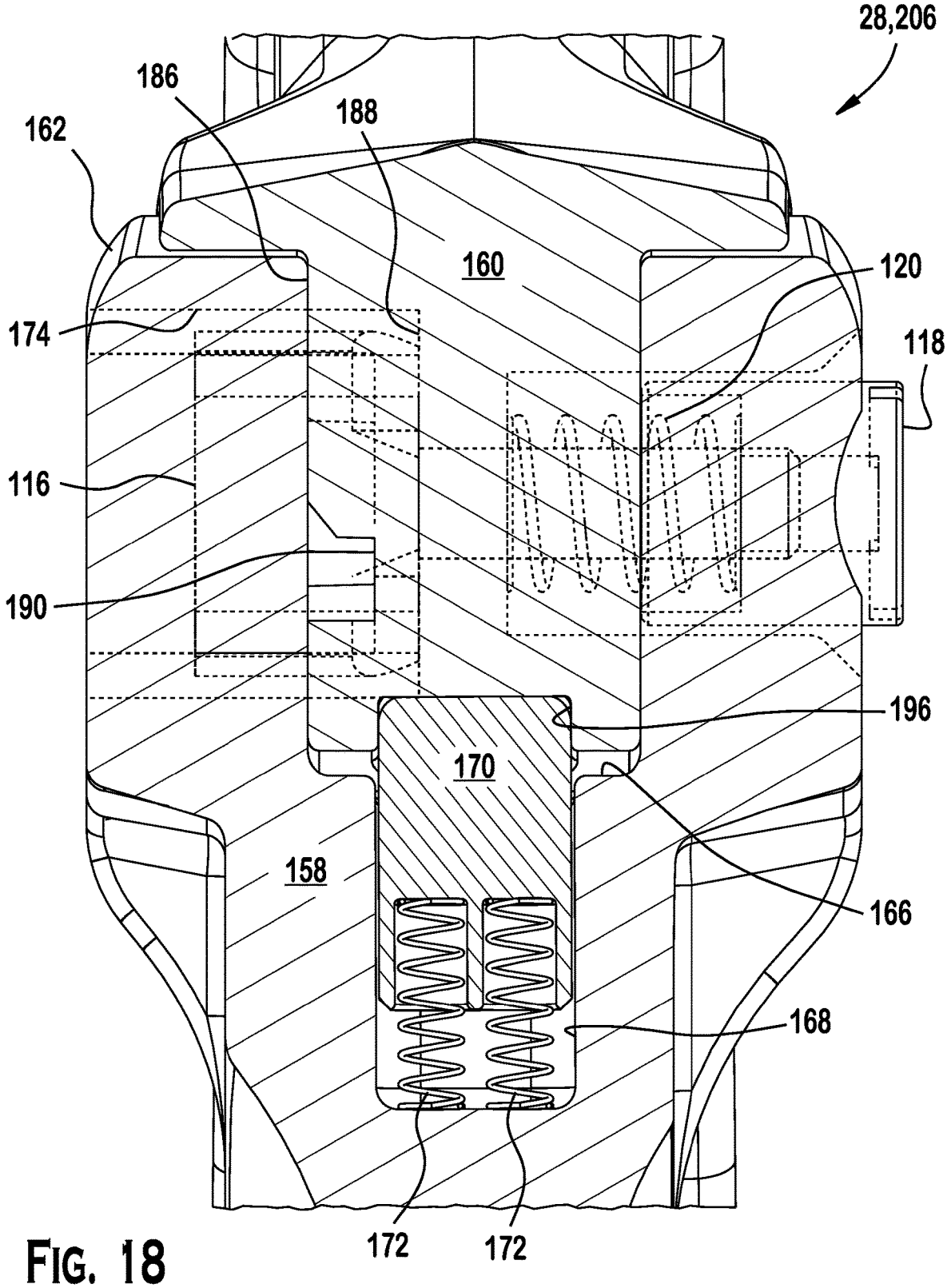
FIG. 18 is a partial sectional view of the proximal joint of the stabilizing accessory along line 18-18 of FIG. 16, the proximal joint being depicted in locked configuration.
Figure 19:
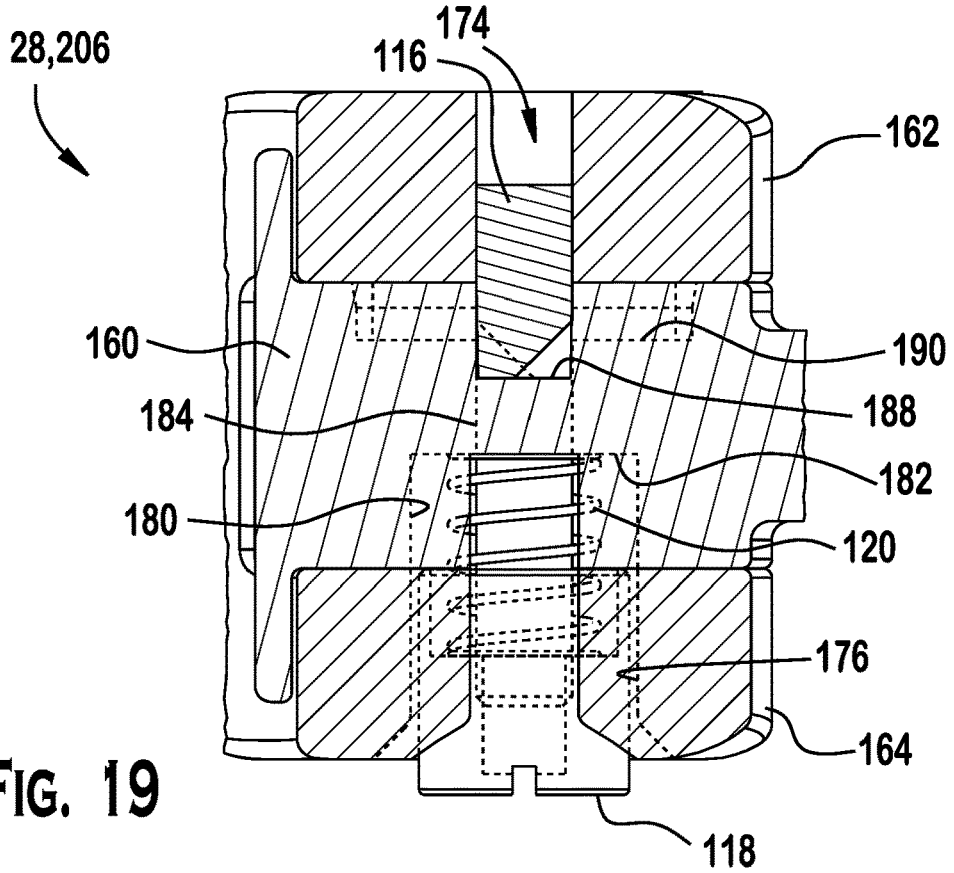
FIG. 19 is a partial sectional view of the proximal joint of the stabilizing accessory along line 19-19 of FIG. 16, the proximal joint being depicted in locked configuration.

Referring to FIGS. 18 and 19, the proximal joint 28 may lock when the latch bolt 116 is seated in the rectangular slot 188 in the starboard side 186 of the proximal eye end 160 and the rectangular slot 174 in the starboard side tine 162. Accordingly, the latch bolt 116 when biased into the rectangular slot 188 may block rotation of the proximal joint 28. Hence, FIG. 19 may depict a partial sectional view of the proximal joint in a locked configuration 206. By contrast, the proximal joint 28 may be unlocked by moving the latch bolt head from the rectangular slot so as to allow rotation of the proximal joint 28 by depressing the lower surface of the latch bolt nut against the coil spring 120 to push the head of the latch bolt out of the rectangular slot.

Figure 20:
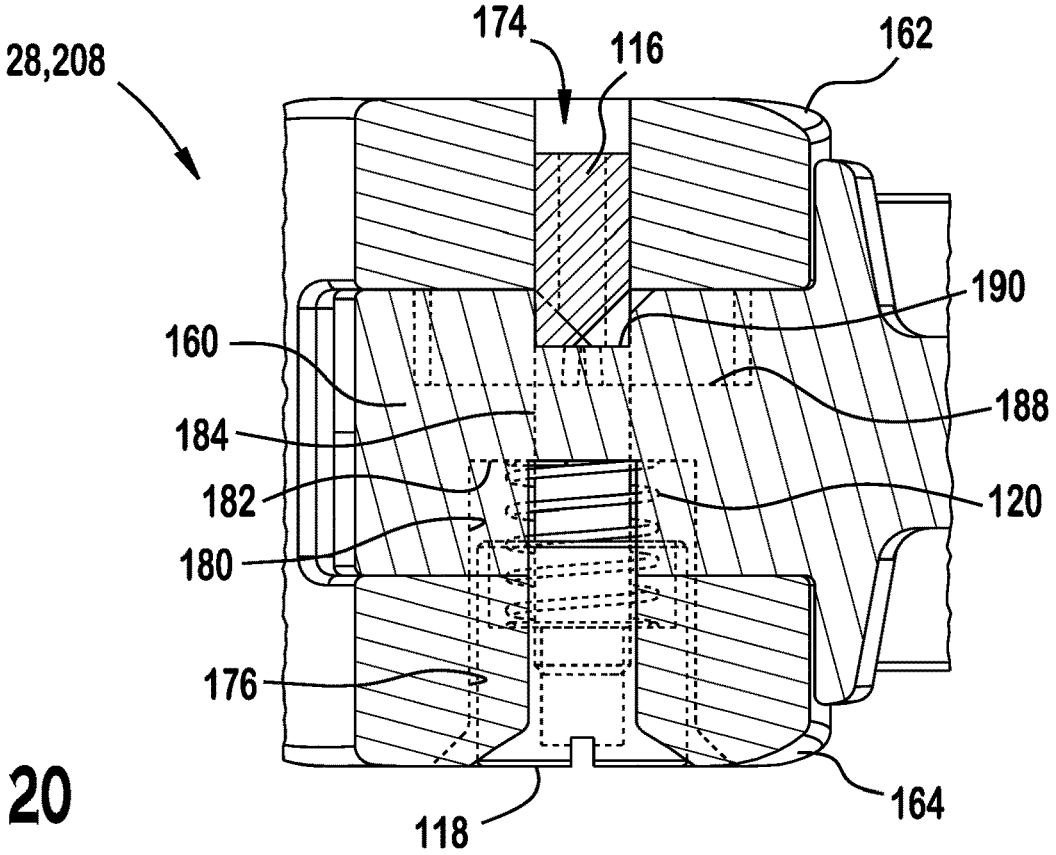
FIG. 20 is a partial sectional view of the proximal joint of the stabilizing accessory along line 20-20 of FIG. 17, the proximal joint being depicted in retention configuration.

By contrast, referring to FIG. 20, the partially tapered slot 190 may be less deep than the rectangular slot 188. The partially tapered slot may include a beveled surface 192 on each side of the interior bore 184. Thus, the head of the latch bolt 116 of the proximal joint 28 may be moveable from the tapered slot by applying a force sufficient to slide the angled faces of the latch bolt up the respective beveled surfaces 192 of the tapered slot 190. Accordingly, FIG. 20 may depict a partial sectional view of the proximal joint in a retention configuration 208.

Figure 24:
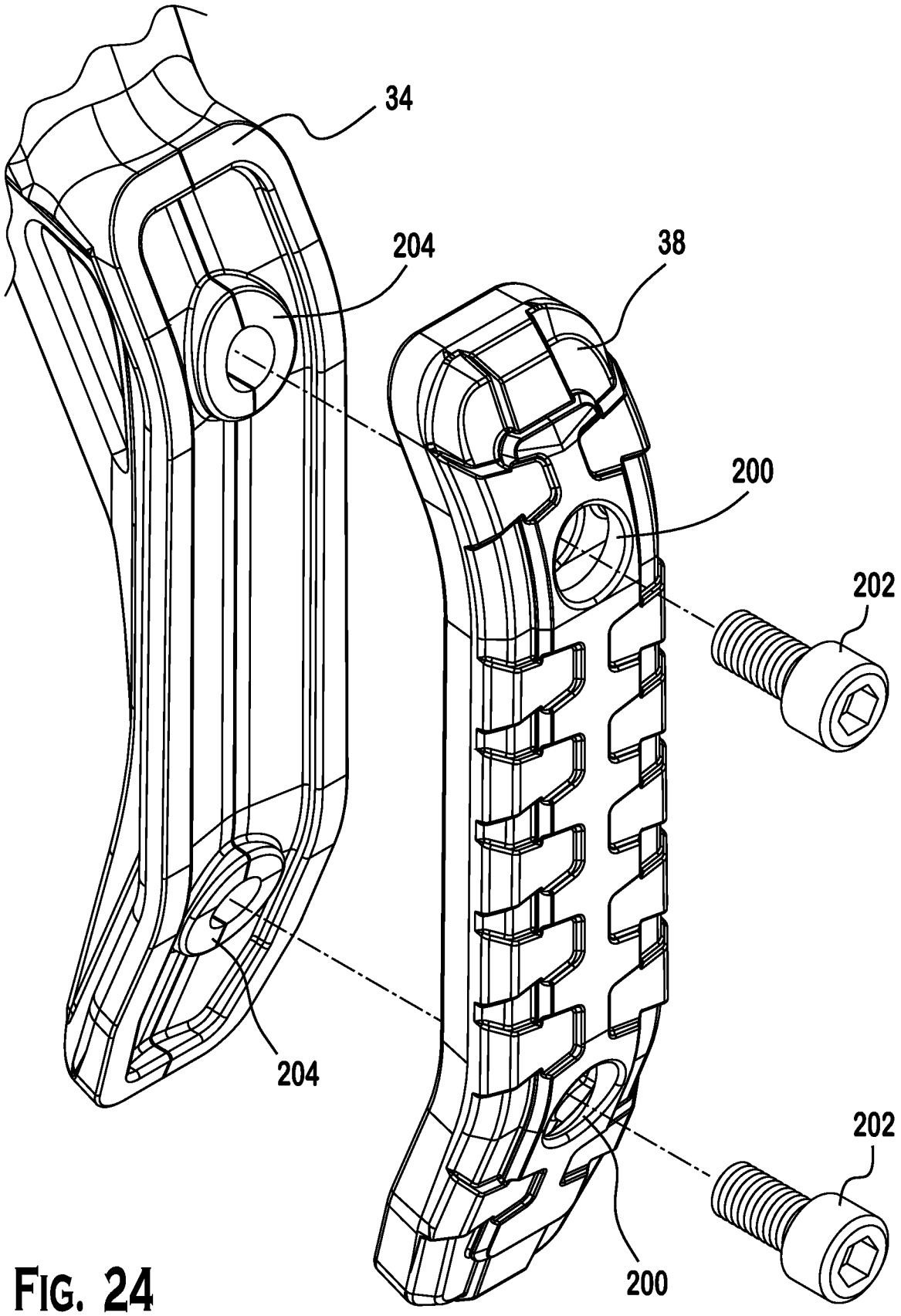
FIG. 24 is a rear left side close-up perspective view of the buttstock and recoil pad of FIG. 6.

Referring to FIG. 24, the brace 34 of the stabilizing device may be capable of receiving a recoil pad 38. The recoil pad may include a pair of fastener receiving holes 200. The recoil pad 38 may be secured to the brace 34 with a pair of threaded fasters 202 that pass through the fastener receiving holes and mate with one or more corresponding fastener attachment sites 204. Although the disclosed attachment sites 204 may be fastener receiving bores that include screw threads, any closure system or other type of fastener pair(s) may be used to attach the recoil pad to the buttstock provided a secure connection is achieved. Preferably, the closure system or other type of fastener pair may allow the recoil pad to be removably secured to the buttstock.

Figure 25:
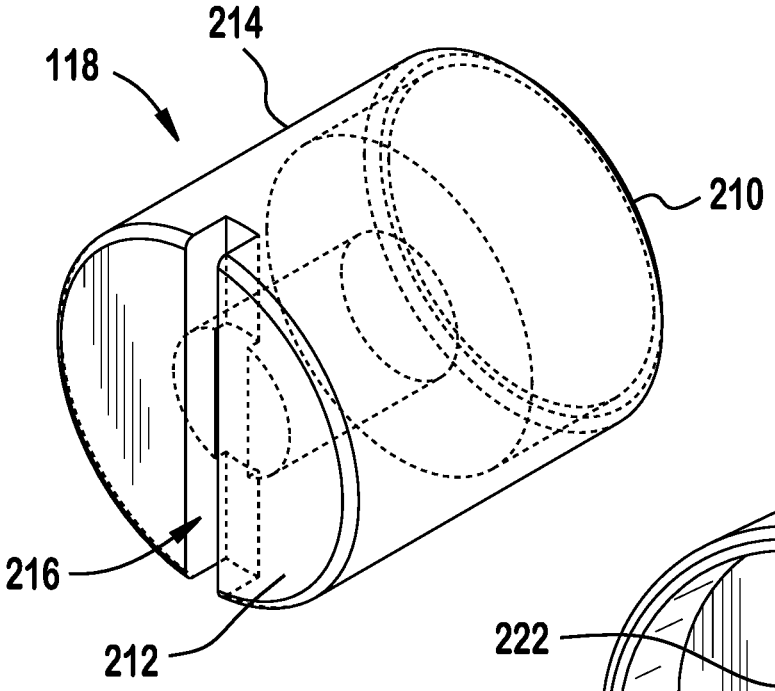
FIG. 25 is a perspective view of the latch bolt nut of FIG. 15.
Figure 26:
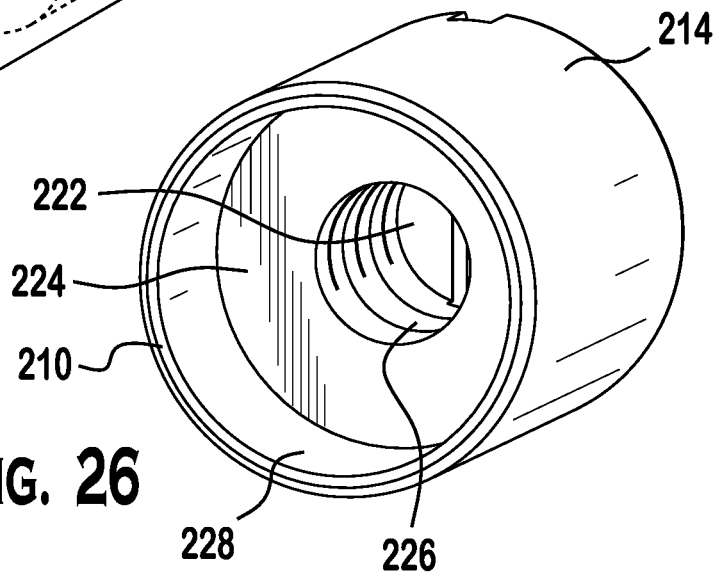
FIG. 26 is another perspective view of the latch bolt nut of FIG. 15.
Figure 27:
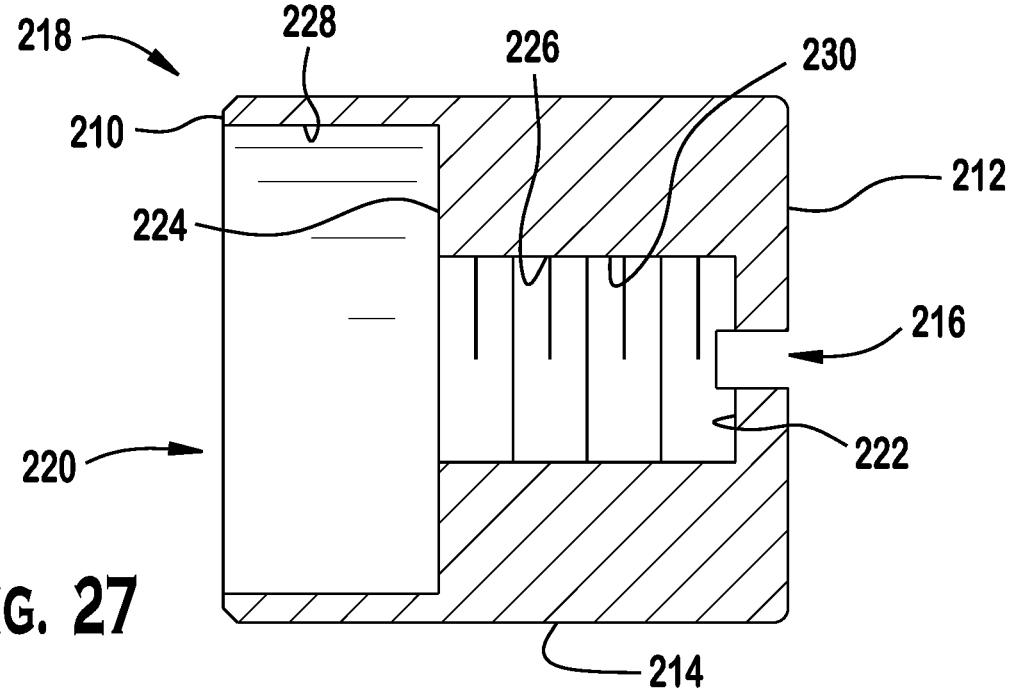
FIG. 27 is a cross-sectional view of the latch bolt nut of FIG. 25 taken perpendicular to the screw drive slot.

FIG. 25, FIG. 26 and FIG. 27 show features of an exemplary latch bolt nut 118. The latch bolt nut 118 may have a threaded portion 230 that is configured and dimensioned to mate with a mating screw thread 122 on the latch bolt 116. Referring to FIG. 25, the latch bolt nut 118 may include an upper surface 210 a lower surface 212 and a side surface 214 extending from the upper surface to the lower surface. The lower surface may include a screw drive 216. For example, the screw drive may be a drive slot. Although the disclosed latch bolt nut 118 has a slot drive, any suitable screw drive type may be used provided it allows the corresponding driver to turn the latch bolt nut 118 when positioned for assembly into the distal joint 26 or the proximal joint 28 (see e.g., FIG. 15 and FIG. 21). For instance, without limitation, the screw drive type may be a Phillips, Hex or Special screw drive type. Referring to FIGS. 26 and 27, the latch bolt nut 118 further may include a stepped bore 218. For example, the stepped bore 218 may extend from the upper surface 210 toward the lower surface 212. The stepped bore may include a stepped bore opening 220, a lower bore end wall 222 spaced from the stepped bore opening, and an upper bore end wall 224. The stepped bore further may include a lower bore side wall 226 and an upper bore side wall 228. The lower bore side wall may include a screw thread 230 which is configured and dimensioned to mate with a screw thread 122 on the latch bolt 116.

Figure 29:
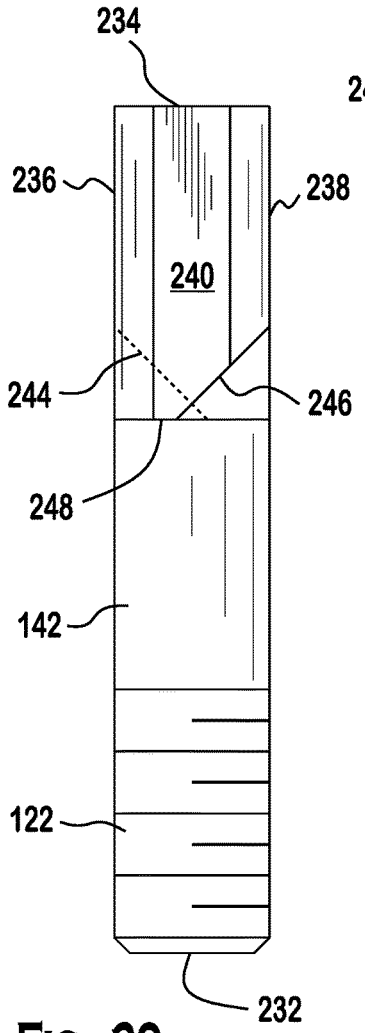
FIG. 29 is a side view of the latch bolt of FIG. 15.
Figure 28:
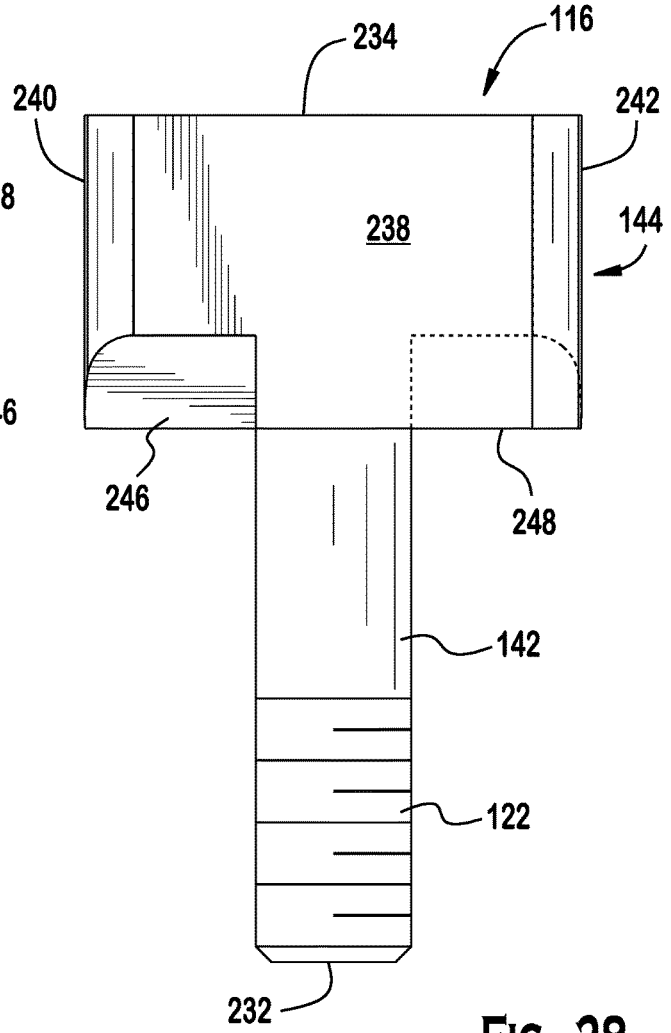
FIG. 28 is side view of the latch bolt of FIG. 15.
Figure 30:
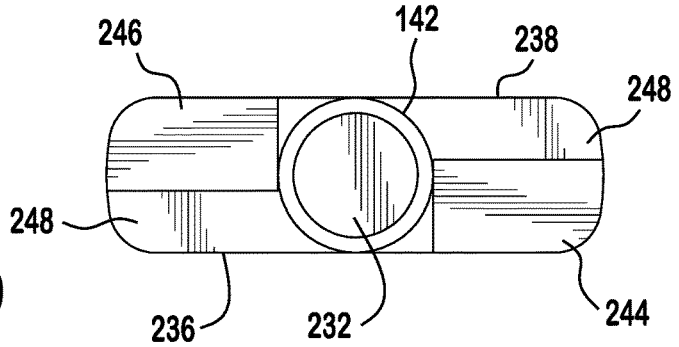
FIG. 30 is a bottom view of the latch bolt of FIG. 15.
Figure 31:
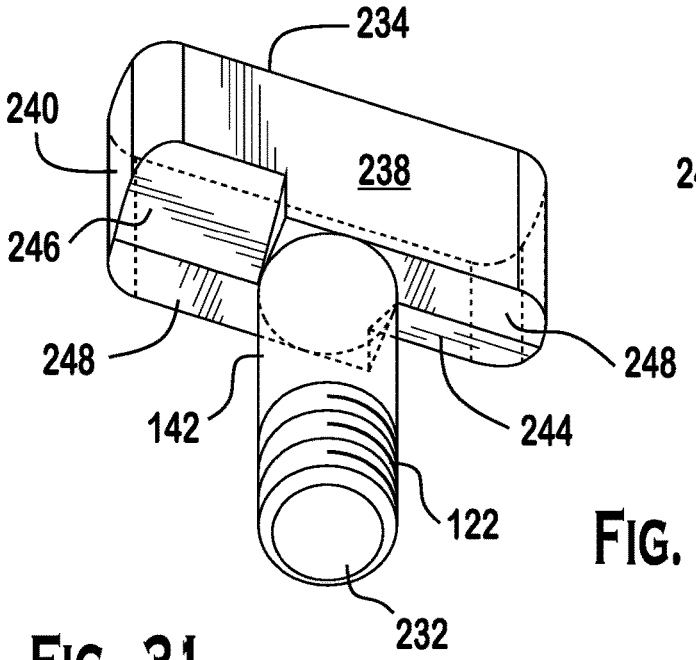
FIG. 31 is a bottom perspective view of the latch bolt of FIG. 15.
Figure 32:
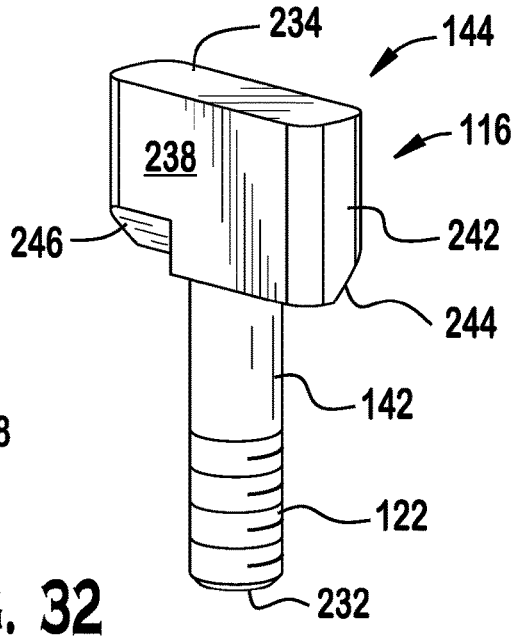
FIG. 32 is a top perspective view of the latch bolt of FIG. 15.

FIGS. 28, 29, 30, 31 and 32 show features of an exemplary latch bolt 116. The latch bolt shank 142 may include a threaded portion 122 near the tip 232 that is configured and dimensioned to mate with a screw thread 230 on the latch bolt nut 118. Referring to FIG. 28 and FIG. 29, the latch bolt head 144 may include an upper surface 234, a port side surface 236, a starboard side surface 238, an aft side surface 240, and a front side surface 242 (not shown). The head 144 further may include a port side angled face 244 and a starboard side angled face 246. Referring to FIG. 30, FIG. 31, and FIG. 32, the latch bolt head 144 further may include a bottom surface 248.

Figure 33:
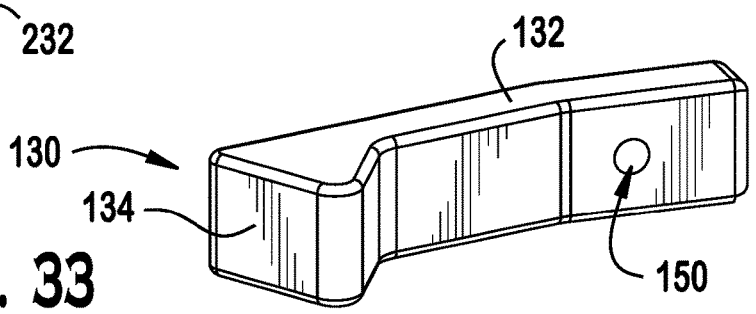
FIG. 33 is a front perspective view of the latch arm of FIG. 15.
Figure 34:
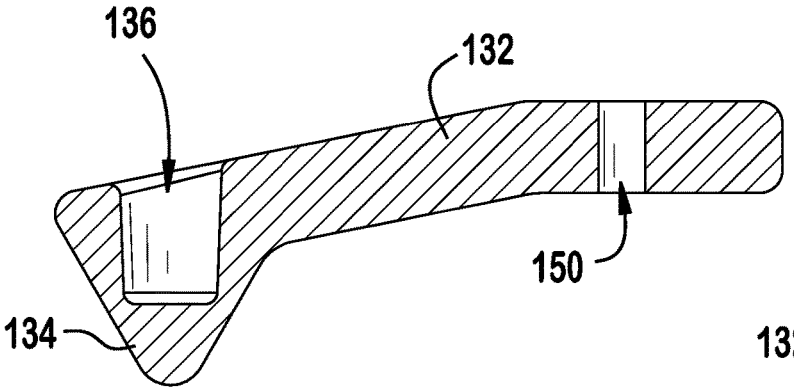
FIG. 34 is a rear perspective view of the latch arm of FIG. 15.
Figure 35:
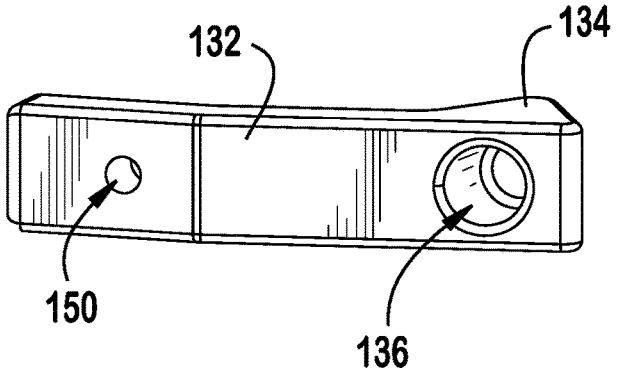
FIG. 35 is a cross-sectional view of the latch arm of FIG. 33 taken along a horizontal plane through the middle of the latch arm.
Figure 36:
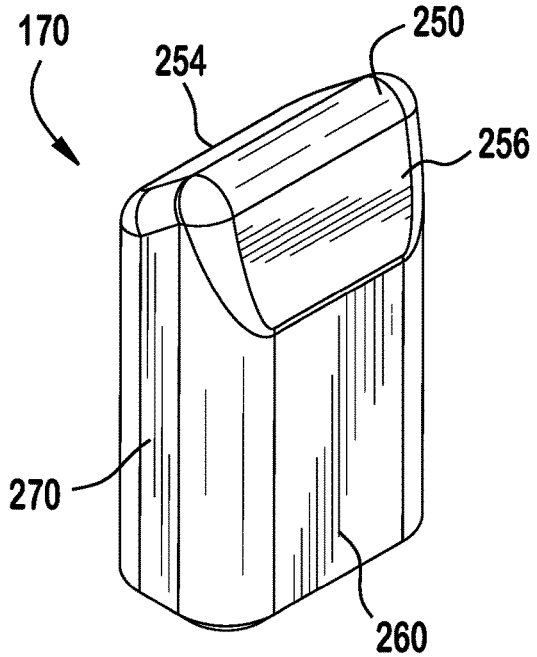
FIG. 36 is a perspective view of the latch bit of FIG. 21.
Figure 40:
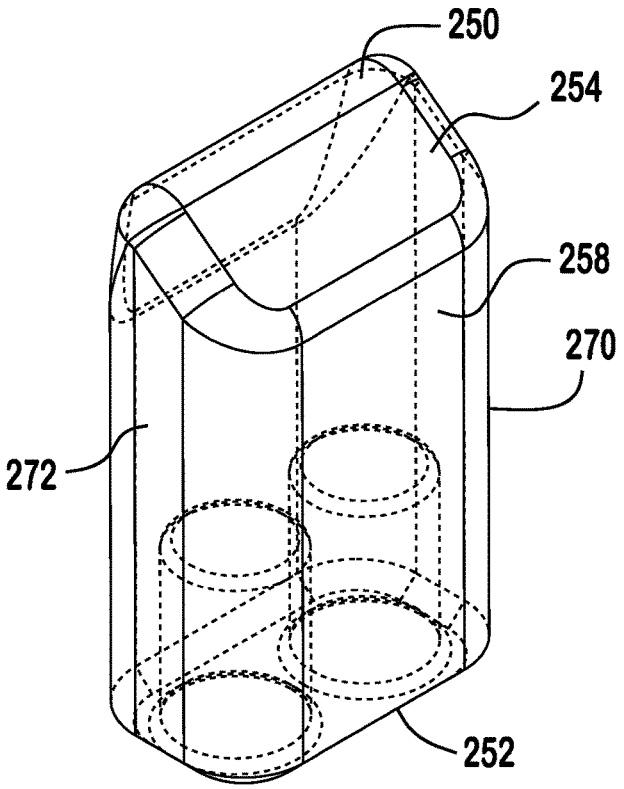
FIG. 40 is another perspective view of the latch bit of FIG. 21.
Figure 37:
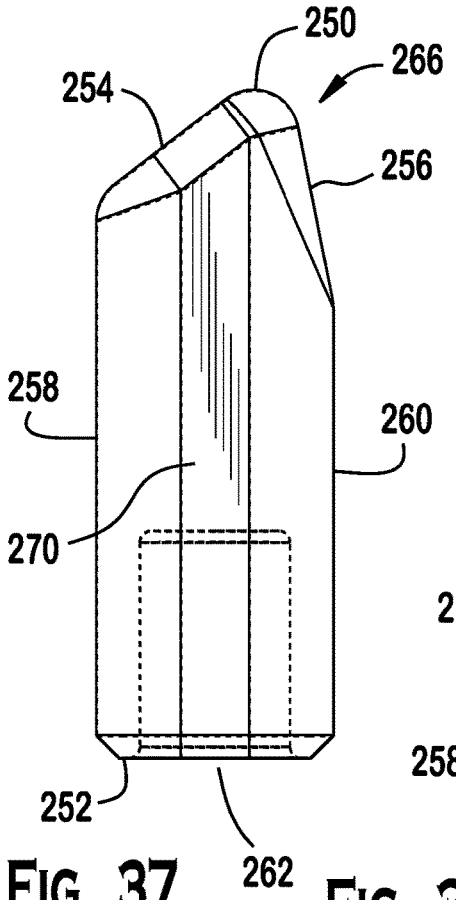
FIG. 37 is a right, side view of the latch bit of FIG. 21.
Figure 38:
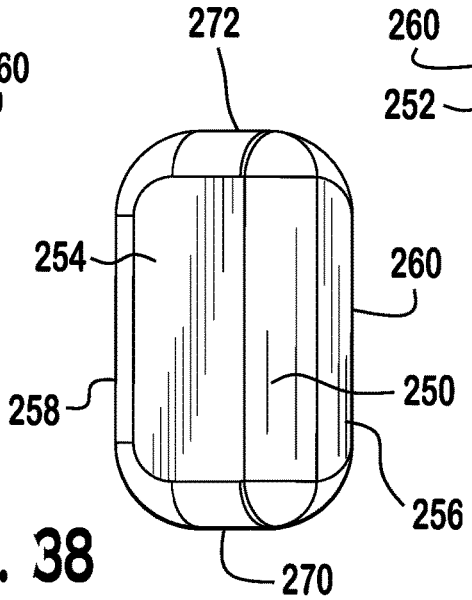
FIG. 38 is a top view of the latch bit of FIG. 21.
Figure 39:
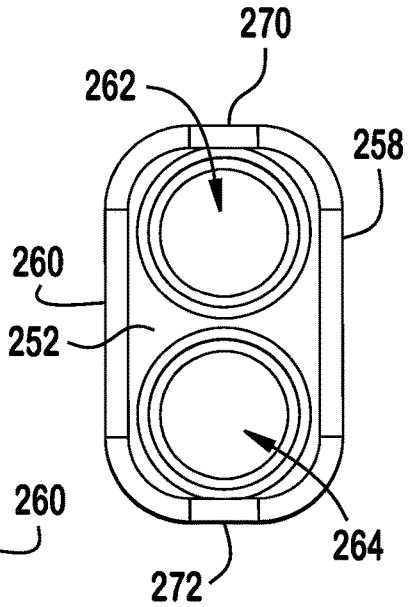
FIG. 39 is a bottom view of the latch bit of FIG. 21.

FIGS. 33, 34 and 35 show features of an exemplary secondary latch (or lateral latching arm) 130. The lateral latching arm 130 may include a wedge-shaped head 134, a fastener receiving bore 150, and a bore 136. The bore 136 may be configured and dimensioned to receive a coil spring.

FIGS. 36, 37, 38, 39 and 40 show features of an exemplary latch bit 170. The latch bit 170 may include a tip 250, a base 252, a superior facet 254, an inferior facet 256, a planar upper surface 258, and a planar lower surface 260. Also, the latch bit 170 may include a right side surface 270 and a left side surface 272. The base further may include two bores 262, 264. Each of the two bores may be configured and dimensioned to receive a coil spring 172. The bores may be aligned with a longitudinal axis of the latch bit. Additionally, tip 170 and the superior facet 254 and the inferior facet 256, respectively, may form a sloped surface. The lower sloped surface 266 of the inferior facet may be different than the upper sloped surface 268 of the superior facet.

Generally, the stabilizing accessory 16 may be formed from one or more materials for example, without limitation, metal, metal alloys, wood, plastic, polymer materials, reinforced polymer materials, thermoplastic materials, and combinations thereof.

In use, an exemplary firearm apparatus 10 may be retrieved by an operator in a stored (or folded) configuration 20. The operator (or user) may grasp the pistol grip 18 of the firearm apparatus 10 with a dominant-hand. The operator further may grasp the brace (or butt) 34 of the firearm apparatus with a non-dominant hand. The operator may pull the brace 34 rearward with their non-dominant hand to position the distal joint 26 in the deployed configuration 22. Further, the operator may pull the brace 34 rearward and upward with their non-dominant hand to position the proximal joint 28 in the deployed configuration 22. In the deployed configuration 22, the distal joint 26 and the proximal joint 28 may each reside in their respective locked configurations 146, 206. The operator further may pull the deployed firearm apparatus 10 toward the operator and press the brace 34 against the operator's upper body. The operator further may obtain a sight alignment for the pistol with the operator's cheek resting against the cheek weld 40. The operator may return the firearm apparatus to the stored configuration 20, in part, by pressing the latch bolt nut 118 of the proximal joint 28 to unlock the proximal joint and then rotating the brace (or butt) 34 to the retention configuration 208. Further, the operator may unlock the distal joint 26 by pressing the latch bolt nut 118 of the distal joint to unlock the distal joint 26, and then rotate the boom 30 and folded brace to the stored configuration 20.

While it has been illustrated and described what at present are considered to be preferred embodiments of the present invention, it will be understood by those skilled in the art that various changes and modifications may be made, and equivalents may be substituted for elements thereof without departing from the true scope of the invention. For example, the shape, materials of construction, and spring force of the coil springs may be adapted for use with a particular geometry. Additionally, features and or elements from any embodiment may be used singly or in combination with other embodiments. Therefore, it is intended that this invention not be limited to the particular embodiments disclosed herein, but that the invention include all embodiments falling within the scope and the spirit of the present invention.

What is claimed is:

1. A firearm stabilizing device for positioning a handgun in spatial relation to an operator's torso, the firearm stabilizing device comprising:

a firearm interface which comprises a stem for connecting to a grip of a handgun, and a first eye end spaced from the stem, the first eye end comprising a first stub which comprises an upper surface, a lower surface, and a first eye which extends from the upper surface to the lower surface, the first eye comprising a first rectangular slot which extends from the upper surface toward the lower surface, the first rectangular slot comprising a first end wall, a first circular bore which extends from the lower surface toward the upper surface, the first circular bore comprising a second end wall, and a first passage extending from the first end wall to the second end wall;

an arm which comprises a first fork end comprising a superior tine, and an inferior tine spaced from the superior tine;

a first latch bolt which comprises a first head and a first shank, the first head being positioned adjacent to the superior tine and the first shank being positioned in the first passage and adjacent to the inferior tine;

a first latch bolt nut positioned in the first circular bore and secured to the first shank; and a first spring positioned intermediate to the second end wall and the first latch bolt nut such that the firearm stabilizing device comprises a first locked configuration in which the first head is positioned in the first rectangular slot and blocks rotation of the first fork end with respect to the first eye, and a first unlocked configuration in which the first head is spaced from the first rectangular slot and allows rotation of the first fork end with respect to the first eye, and the first spring biases the first latch bolt in the first locked configuration.

2. The firearm stabilizing device of claim 1, wherein the superior tine further comprises:

a first top surface, a first bottom surface, and a first superior slot which extends from the first top surface to the first bottom surface, the first superior slot comprising a rectangular shape.

3. The firearm stabilizing device of claim 2, wherein the inferior tine further comprises:

a second top surface, a second bottom surface, and a second bore which extends from the second top surface to the second bottom surface.

4. The firearm stabilizing device of claim 3, wherein the first head is positioned in the first superior slot and the first shank is positioned in the second bore.

5. The firearm stabilizing device of claim 4, wherein the first latch bolt nut is positioned in the first circular bore and the second bore.

6. The firearm stabilizing device of claim 1, further comprising an elongated member comprising a wedge-shaped head, a third circular bore opposite the wedge-shaped head, and a fastener receiving bore spaced from the wedge-shaped head, wherein the first fork end further comprises a pocket adjacent to the superior tine and the inferior tine, and the elongated member is positioned in the pocket.

7. The firearm stabilizing device of claim 6, wherein the first fork end further comprises a fastener receiving hole which traverses the first fork end proximate the pocket.

8. The firearm stabilizing device of claim 7, further comprising:

a fixation pin positioned in the fastener receiving hole and the fastener receiving bore, and a second spring positioned in the third circular bore such that the second spring biases the wedge-shaped head away from the pocket.

9. The firearm stabilizing device of claim 8, wherein the first stub further comprises an exterior sidewall disposed between the upper surface and the lower surface, and the exterior sidewall comprises a first wedge-shaped notch disposed at a first location and a second wedge-shaped notch disposed at a second location.

10. The firearm stabilizing device of claim 9, wherein the second spring biases the wedge-shaped head into the first notch when the firearm stabilizing device is in the first locked configuration.

11. The firearm stabilizing device of claim 10, wherein the second spring biases the wedge-shaped head into the second notch when the firearm stabilizing device is in the first unlocked configuration.

12. The firearm stabilizing device of claim 9, wherein the first stub comprises a starboard side and a port side, the first notch being disposed on the starboard side, and the second notch being disposed on the port side.

13. The firearm stabilizing device of claim 1, wherein the arm further comprises a second fork end spaced from the first fork end, the second fork end comprising:

a starboard side tine comprising a first starboard side surface, a first port side surface, and a second rectangular slot which extends from the first starboard side surface to the first port side surface, and a port side tine spaced from the starboard side tine, the port side tine comprising a second starboard side surface, a second port side surface, and a fourth circular bore which extends from the second starboard side surface to the second port side surface.

14. The firearm stabilizing device of claim 13, wherein the second fork end further comprises a receptacle for housing a positioning latch.

15. The firearm stabilizing device of claim 14, further comprising a latch bit positioned in the receptacle.

16. The firearm stabilizing device of claim 15, wherein the latch bit comprises:

a tip, and a base spaced from the tip.

17. The firearm stabilizing device of claim 16, wherein the latch bit further comprises a fifth circular bore and a sixth circular bore, the fifth circular bore and the sixth circular bore, respectively, extending from the base toward the tip.

18. The firearm stabilizing device of claim 13, further comprising a boom positioned adjacent to the arm, the boom comprising:

a second eye end, and a brace spaced from the second eye end, the brace comprising a buttstock.

19. The firearm stabilizing device of claim 18, wherein the boom further comprises a handle disposed between the second eye end and the buttstock, the handle comprising a smooth curved surface.

20. The firearm stabilizing device of claim 18, wherein the buttstock comprises a recoil pad.

21. The firearm stabilizing device of claim 18, wherein the second eye end comprises:

a second stub which comprises a starboard side surface, a port side surface, and a second eye which extends from the starboard side surface to the port side surface, the second eye comprising a third rectangular slot which extends from the starboard side surface toward the port side surface, the third rectangular slot comprising a third end wall, a fourth rectangular slot which extends from the starboard side surface toward the port side surface, the fourth rectangular slot intersecting the third rectangular slot, the fourth rectangular slot comprising a beveled side wall and a fourth end wall adjacent to the beveled side wall, a seventh circular bore which extends from the port side surface toward the starboard side surface, the seventh circular bore comprising a fifth end wall, and a second passage extending from the third end wall to the fifth end wall.

22. The firearm stabilizing device of claim 21, further comprising:

a second latch bolt which comprises a second head and a second shank, the second head being positioned in the second rectangular slot and the second shank being positioned in the second passage and the seventh circular bore;

a second latch bolt nut positioned in the fourth circular bore and the seventh circular bore, the second latch bolt nut being secured to the second shank; and a third spring positioned intermediate to the fourth end wall and the second latch bolt nut such that the firearm stabilizing device comprises a second locked configuration in which the second head is positioned in the second rectangular slot and blocks rotation of the second fork end with respect to the second eye, and a second unlocked configuration in which the second head is spaced from the second rectangular slot and allows rotation of the second fork end with respect to the second eye, and the third spring biases the second latch bolt in the second locked configuration.

23. The firearm stabilizing device of claim 18, wherein the first eye end and the first fork end comprise a distal joint, and the second eye end and the second fork end comprise a proximal joint, the distal joint oscillates about a first coordinate axis, and the second joint oscillates about a second coordinate axis perpendicular to the first coordinate axis.

24. A firearm stabilizing apparatus comprising:

a pistol comprising a pistol grip, and a firearm stabilizing device of claim 1 connected to the pistol grip.

* * * * *